US011512507B2

(12) United States Patent
Masuda et al.

(10) Patent No.: US 11,512,507 B2
(45) Date of Patent: Nov. 29, 2022

(54) LOCK DEVICE

(71) Applicant: AISIN CORPORATION, Kariya (JP)

(72) Inventors: Atsuyuki Masuda, Fujisawa (JP); Hideo Morimoto, Fujisawa (JP)

(73) Assignee: AISIN CORPORATION, Kariya (JP)

( * ) Notice: Subject to any disclaimer, the term of this patent is extended or adjusted under 35 U.S.C. 154(b) by 0 days.

(21) Appl. No.: 17/323,301

(22) Filed: May 18, 2021

(65) Prior Publication Data

US 2021/0363790 A1 Nov. 25, 2021

(30) Foreign Application Priority Data

May 22, 2020 (JP) ..... JP2020-089757
May 22, 2020 (JP) ..... JP2020-089758
May 22, 2020 (JP) ..... JP2020-089759

(51) Int. Cl.

*E05B 83/18* (2014.01)
*E05B 81/14* (2014.01)
*E05B 81/06* (2014.01)
*E05B 81/36* (2014.01)

(52) U.S. Cl.

CPC ..... *E05B 83/18* (2013.01); *E05B 81/14* (2013.01); *E05B 81/06* (2013.01); *E05B 81/36* (2013.01)

(58) Field of Classification Search

CPC ..... E05B 83/18; E05B 81/06; E05B 81/14; E05B 81/18; E05B 81/20; E05B 81/30; E05B 81/34; E05B 81/36; E05B 85/20; E05B 85/24; E05B 85/243; E05B 85/26; Y10T 292/1047; Y10T 292/1082; Y10S 292/05; Y10S 292/14; Y10S 292/23; Y10S 292/42

See application file for complete search history.

(56) References Cited

U.S. PATENT DOCUMENTS

2014/0340808 A1 11/2014 Kurita et al.
2018/0171677 A1* 6/2018 Im ..... E05B 83/18
2018/0171679 A1* 6/2018 Im ..... E05B 81/34
2018/0223568 A1* 8/2018 Cho ..... E05B 81/15

FOREIGN PATENT DOCUMENTS

JP 2013136874 A 7/2013
WO WO-2016132463 A1 * 8/2016 ..... E05B 81/14
WO WO-2018030556 A2 * 2/2018 ..... E05B 81/06

* cited by examiner

*Primary Examiner* — Christine M Mills
*Assistant Examiner* — Christopher F Callahan
(74) *Attorney, Agent, or Firm* — Buchanan Ingersoll & Rooney PC

(57) ABSTRACT

A lock device includes a latch configured to rotate between a full latch position and an unlatch position, a pawl configured to rotate between a hook position and a retracted position, an open lever configured to rotate the pawl to the retracted position, and a drive lever including an open lever pushing portion. When rotated in a first direction, the open lever pushing portion rotates the open lever in an open direction. During an open action, the open lever pushing portion rotates in the first direction while rotating the open lever in the open direction at least until the latch starts an unlatch action, and rotates in the first direction without rotating the open lever in the open direction after the latch starts the unlatch action.

11 Claims, 21 Drawing Sheets

LOCK DEVICE

BACKGROUND

1. Field

The following description relates to a lock device.

2. Description of Related Art

Japanese Laid-Open Patent Publication No. 2013-136874 describes a vehicle including a vehicle body, a rear door, and a lock device. The rear of the vehicle body includes an opening. The rear door rotates between a fully closed position where the opening is fully closed and a fully open position where the opening is fully open. When the rear door is located at the fully closed position, the lock device restrains the rear door to the vehicle body.

The vehicle body includes a striker at a lower end of the opening. The lock device includes a latch and a pawl. The latch rotates between a fully latched position where the latch hooks on the striker and an unlatched position where the latch is unhooked from the striker. When the latch is located at the fully latched position, the pawl holds the latch in the fully latched position. The lock device further includes an open lever configured to rotate the pawl in a direction away from the latch, a close lever configured to rotate the latch toward the fully latched position, and a drive lever configured to drive the open lever when rotating in a first direction and drive the close lever when rotating in a second direction that is opposite to the first direction.

When opening the rear door, the lock device performs an open action to release the rear door from restraint at the fully closed position. During the open action, the lock device rotates the drive lever in the first direction to drive the pawl with the open lever. Thus, the lock device rotates the latch to the unlatched position. When the rear door is closed to the proximity of the fully closed position, the lock device performs a closing action to restrain the rear door in the fully closed position. During the closing action, the lock device rotates the drive lever in the second direction to drive the latch with the close lever. Thus, the lock device rotates the latch to the fully latched position. In the description hereafter, rotating the latch to the unlatched position during the open action is referred to as "the unlatch action." Rotating the latch to the fully latched position during the closing action is referred to as "the full latch action."

In a lock device as described above, regardless of individual differences between lock devices and environmental factors, it is preferred that the rotation amount of the drive lever in the first direction during the open action is set to be large so that the unlatch action is completed during the open action. However, in this case, when the open lever has reached the end of the rotation range, the open lever cannot rotate in an open direction, whereas the drive lever tries to rotate in the first direction. This may apply an overload to the open lever.

Such a situation is not limited to a lock device used for a rear door and generally occurs in other lock devices used for an opening-closing body that opens and closes an opening.

SUMMARY

It is an objective of the present disclosure to provide a lock device that limits an overload applied to an open lever during an open action.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a first aspect of the present disclosure, a lock device is provided on one of a vehicle body including an opening or an opening-closing body that opens and closes the opening of the vehicle body. The lock device is configured to hook on a striker, which is provided on the other one of the vehicle body or the opening-closing body, to restrain the opening-closing body at a fully closed position when the opening is closed. The lock device includes a latch, a pawl, an open lever, and a drive lever. The latch is configured to rotate between a full latch position where the latch hooks on the striker and an unlatch position where the latch is unhooked from the striker. The latch is urged from the full latch position toward the unlatch position. The pawl is configured to rotate between a hook position where the pawl hooks on the latch located at the full latch position to restrict rotation of the latch toward the unlatch position and a retracted position where the pawl is separated from the latch located at the full latch position to allow rotation of the latch. The pawl is urged from the retracted position toward the hook position. The open lever is configured to rotate in an open direction to rotate the pawl to the retracted position and is urged in a direction opposite to the open direction. The drive lever includes an open lever pushing portion. When rotated in a first direction, the open lever pushing portion pushes the open lever to rotate the open lever in the open direction. Rotating the latch from the full latch position to the unlatch position is referred to as an unlatch action. Rotating the drive lever in the first direction so that the latch performs the unlatch action is referred to as an open action. During the open action, the open lever pushing portion rotates in the first direction while rotating the open lever in the open direction at least until the latch starts the unlatch action, and rotates in the first direction without rotating the open lever in the open direction after the latch starts the unlatch action.

During the open action, after the latch starts the unlatch action, the lock device described above rotates the drive lever in the first direction without rotating the open lever in the open direction. In other words, the lock device rotates the drive lever in the first direction so that the open lever does not rotate in the open direction. Thus, even when the drive lever continues to rotate in the first direction after the unlatch action is started the lock device limits an overload applied to the open lever.

In a second aspect of the present disclosure, the lock device further includes a close lever configured to rotate in a close direction to rotate the latch to the full latch position. The close lever is urged in a direction opposite to the close direction. The drive lever includes a close lever pushing portion. When rotated in a second direction that is opposite to the first direction, the close lever pushing portion pushes the close lever to rotate the close lever in the close direction. The open lever pushing portion and the close lever pushing portion extend in opposite directions in a direction in which a rotation axis of the drive lever extends.

In a conventional lock device, during the open action, after the drive lever is rotated in the first direction so that the latch performs the unlatch action, the rotation direction of the drive lever is switched to the second direction so that the drive lever returns to a neutral position. In this configuration, when the drive lever returns, if the drive lever is rotated beyond the neutral position in the second direction, the drive lever may contact the close lever. Also, in the conventional lock device, during the closing action, after the drive lever is rotated in the second direction so that the latch performs the full latch action, the rotation direction of the drive lever is switched to the first direction so that the drive lever returns to the neutral position. In this configuration, when the drive lever returns, if the drive lever is rotate beyond the neutral position in the first direction, the drive lever may contact the open lever.

In this regard, in a lock device, it is preferred that the rotation range of the drive lever includes a large neutral range in which the drive lever does not drive either the open lever or the close lever. Such a configuration is not limited to a lock device used for a rear door and is generally applied to other lock devices used for an opening-closing body that opens and closes an opening.

In the lock device according to the second aspect of the present disclosure, the open lever pushing portion and the close lever pushing portion extend in opposite directions. With this configuration, the distance between the open lever pushing portion and the close lever pushing portion is freely set in the rotation direction of the drive lever. As a result, during the open action, when the drive lever returns to the neutral position, the close lever pushing portion is not likely to push the close lever. During the closing action, when the drive lever returns to the neutral position, the drive lever is not likely to push the open lever. Thus, the lock device increases the neutral range of the drive lever.

In a third aspect of the present disclosure, the lock device further includes a close lever configured to rotate in a close direction to rotate the latch to the full latch position. The close lever is urged in a direction opposite to the close direction. The drive lever includes a close lever pushing portion. When rotated in a second direction that is opposite to the first direction, the close lever pushing portion pushes the close lever to rotate the close lever in the close direction. A rotation axis of the drive lever and a rotation axis of the open lever extend in different directions. The rotation axis of the drive lever and a rotation axis of the close lever extend in different directions.

When a lock device is configured so that the rotation axis of the open lever, the rotation axis of the close lever, and the rotation axis of the drive lever extend in the same direction, the open lever, the close lever, and the drive lever need to be arranged on the same plane. This decreases the degree of freedom for arranging components of the device. In this regard, in the lock device according to the third aspect of the present disclosure, the rotation axis of the drive lever extends in a direction that differs from that of the rotation axis of the open lever and the that of the rotation axis of the close lever. Thus, the lock device does not need to arrange all of the open lever, the close lever, and the drive lever on the same plane. This increases the degree of freedom for arranging components in the lock device.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An embodiment of a vehicle including a lock device will now be described with reference to the drawings. In the description hereafter, the width-wise direction of the vehicle may be referred to as "the width-wise direction," the front-rear direction of the vehicle may be referred to as "the front-rear direction," and the vertical direction of the vehicle may be referred to as "the vertical direction."

Figure 1:
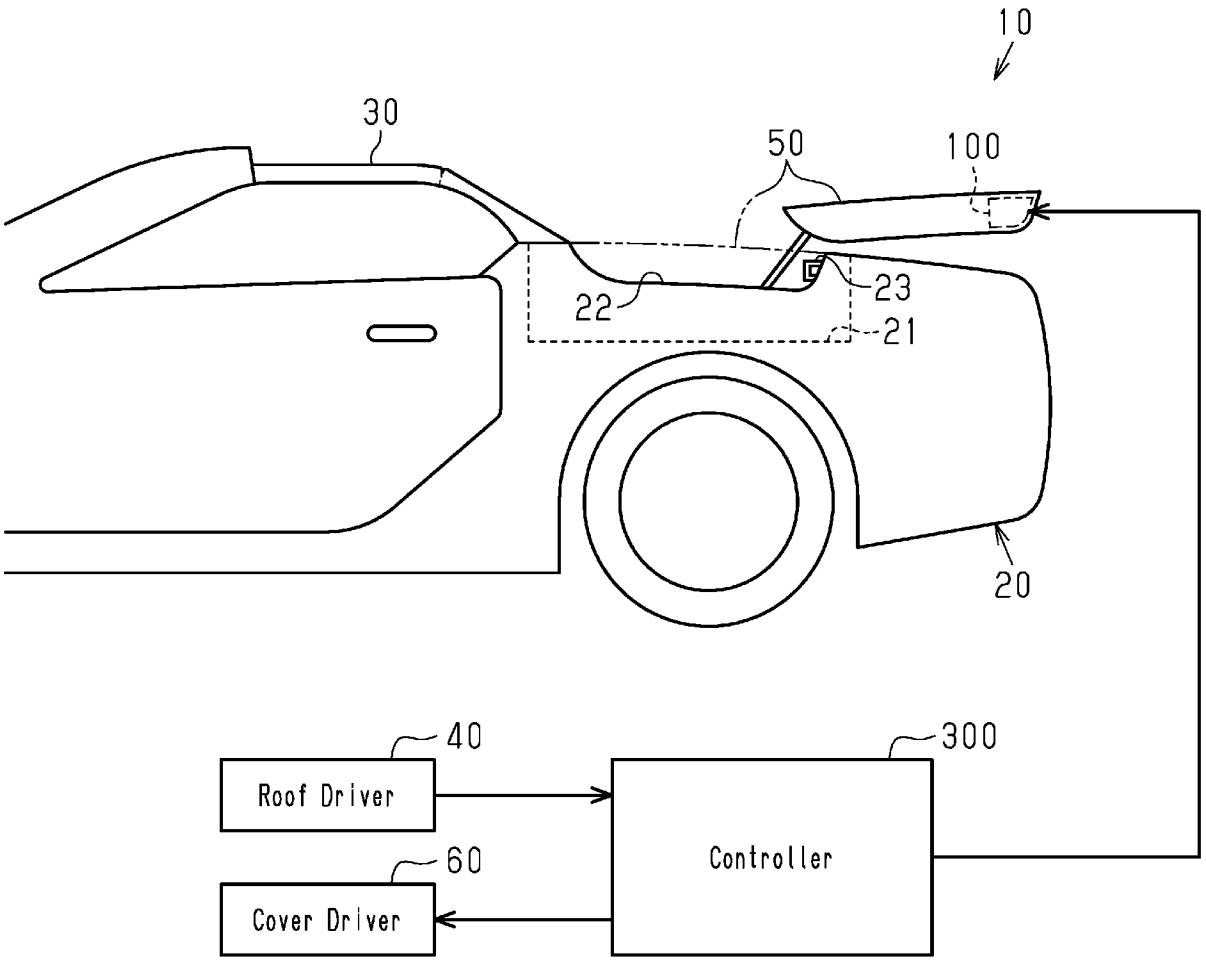
FIG. 1 is a schematic diagram of a vehicle including an embodiment of a lock device.

As shown in FIG. 1, a vehicle 10 includes a vehicle body 20 having a rear portion including a storage compartment 21, a movable roof 30, a roof driver 40 that drives the roof 30, a cover 50 that opens and closes an opening 22 of the storage compartment 21, a cover driver 60 that drives the cover 50, and a lock device 100 that restrains the cover 50 on the vehicle body 20 when the cover 50 is located at a fully closed position. The vehicle 10 further includes a controller 300 that controls the roof driver 40, the cover driver 60, and the lock device 100. The vehicle 10 of the present embodiment is a convertible.

In the vehicle body 20, the storage compartment 21 is a downwardly recessed cavity. Viewed in plan view from above, the opening 22 of the storage compartment 21 is rectangular so that the long sides extend in the width-wise direction and the short sides extend in the front-rear direction. A striker 23 is fixed to a rear end of the opening 22 and is substantially U-shaped as viewed in the width-wise direction. The striker 23 projects frontward.

The roof 30 is actuated by the roof driver 40 between a deployed position where the roof 30 forms an upper portion of the vehicle and a stored position where the roof 30 is stored in the storage compartment 21. When the roof 30 performs a storing action from the deployed position toward the stored position, the roof 30 is mountain-folded so that the fold line extends in the width-wise direction. When the roof 30 moves from the stored position to the deployed position, the roof 30 is deployed from the folded state. The roof 30 may be a hardtop or a soft-top.

The cover 50 corresponds to an example of the "opening-closing body." Viewed in plan view from above, the cover 50 is rectangular so that the long sides extend in the width-wise direction and the short sides extend in the front-rear direction. Preferably, the cover 50 is sized to cover the opening 22 with no gap. The cover 50 is actuated by the cover driver 60 between a fully closed position where the opening 22 is fully closed and a fully open position where the opening 22 is fully open. In FIG. 1, the cover 50 located at the fully closed position is indicated by a double-dashed line, and the cover 50 located at the fully open position is indicated by a solid line. The fully open position of the cover 50 may differ from that shown in FIG. 1 as long as there is no interference with the driving of the roof 30.

The lock device 100 will now be described in detail.

Figure 2:
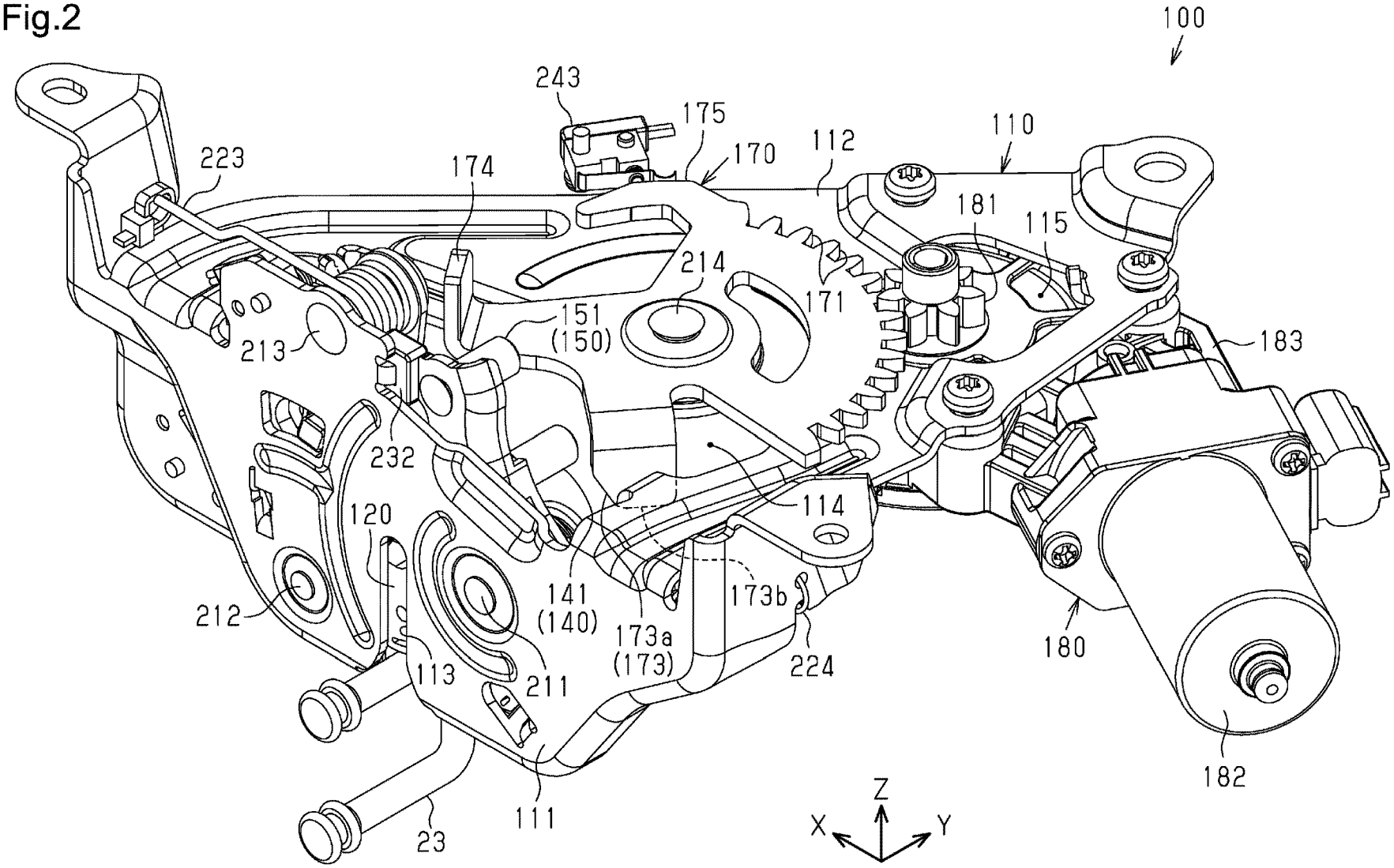
FIG. 2 is a perspective view of the lock device.
Figure 3:
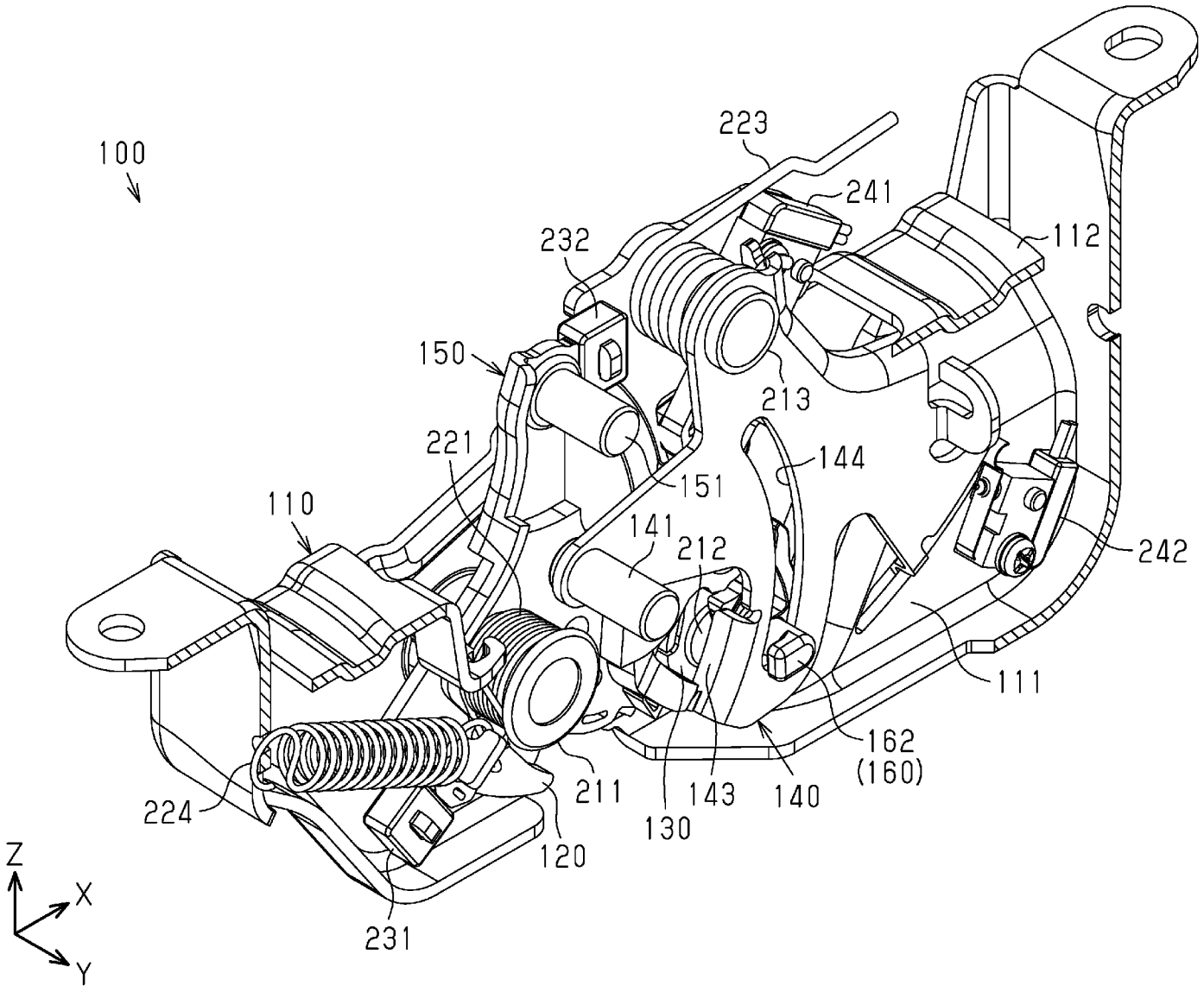
FIG. 3 is a perspective view of the lock device.

As shown in FIG. 2, the lock device 100 includes a housing 110 that supports components of the device. As shown in FIG. 3, the lock device 100 includes a latch 120, a pawl 130, an open lever 140, a close lever 150, and an interlock lever 160. The latch 120 rotates between a full latch position, at which the latch 120 hooks on the striker 23, and an unlatch position, at which the latch 120 is unhooked from the striker 23. The pawl 130 rotates between a hook position, at which the pawl 130 hooks on the latch 120 located at the full latch position, and a retracted position, at which the pawl 130 is separated from the latch 120 located at the full latch position. The open lever 140 drives the pawl 130. The close lever 150 drives the latch 120. The interlock lever 160 moves together with the open lever 140 and the close lever 150. As shown in FIG. 2, the lock device 100 includes a drive lever 170 that drives the open lever 140 and the close lever 150 and a lock driver 180 that drives the drive lever 170.

As shown in FIGS. 2 and 3, the lock device 100 includes a latch support shaft 211 that rotationally supports the latch 120 and the close lever 150, a pawl support shaft 212 that rotationally supports the pawl 130, an open lever support shaft 213 that rotationally supports the open lever 140, a drive lever support shaft 214 that rotationally supports the drive lever 170, and a coupling shaft 215 that couples the close lever 150 to the interlock lever 160 so that the close lever 150 rotates relative to the interlock lever 160.

Figure 4:
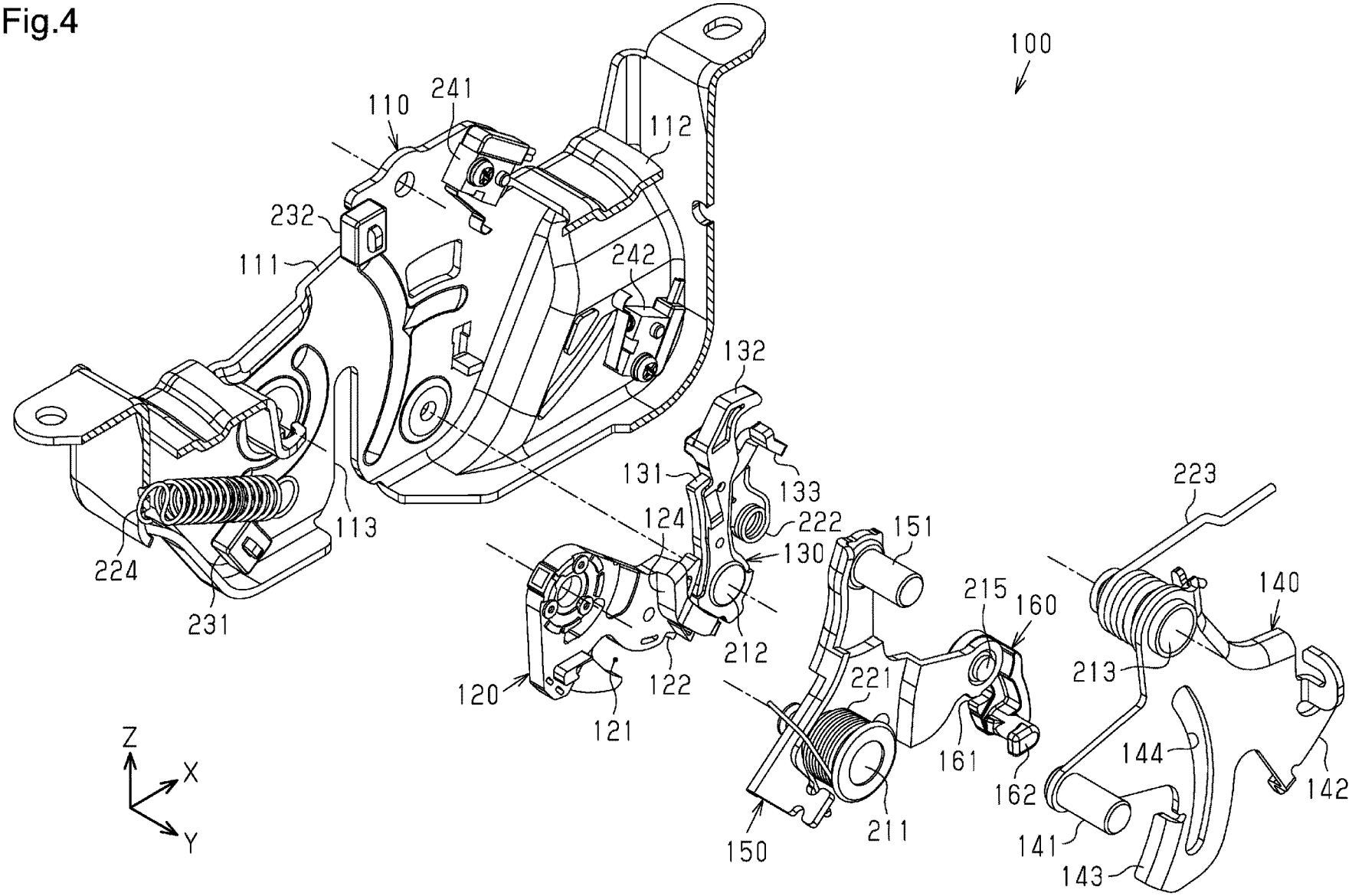
FIG. 4 is an exploded perspective view of the lock device.
Figure 5:
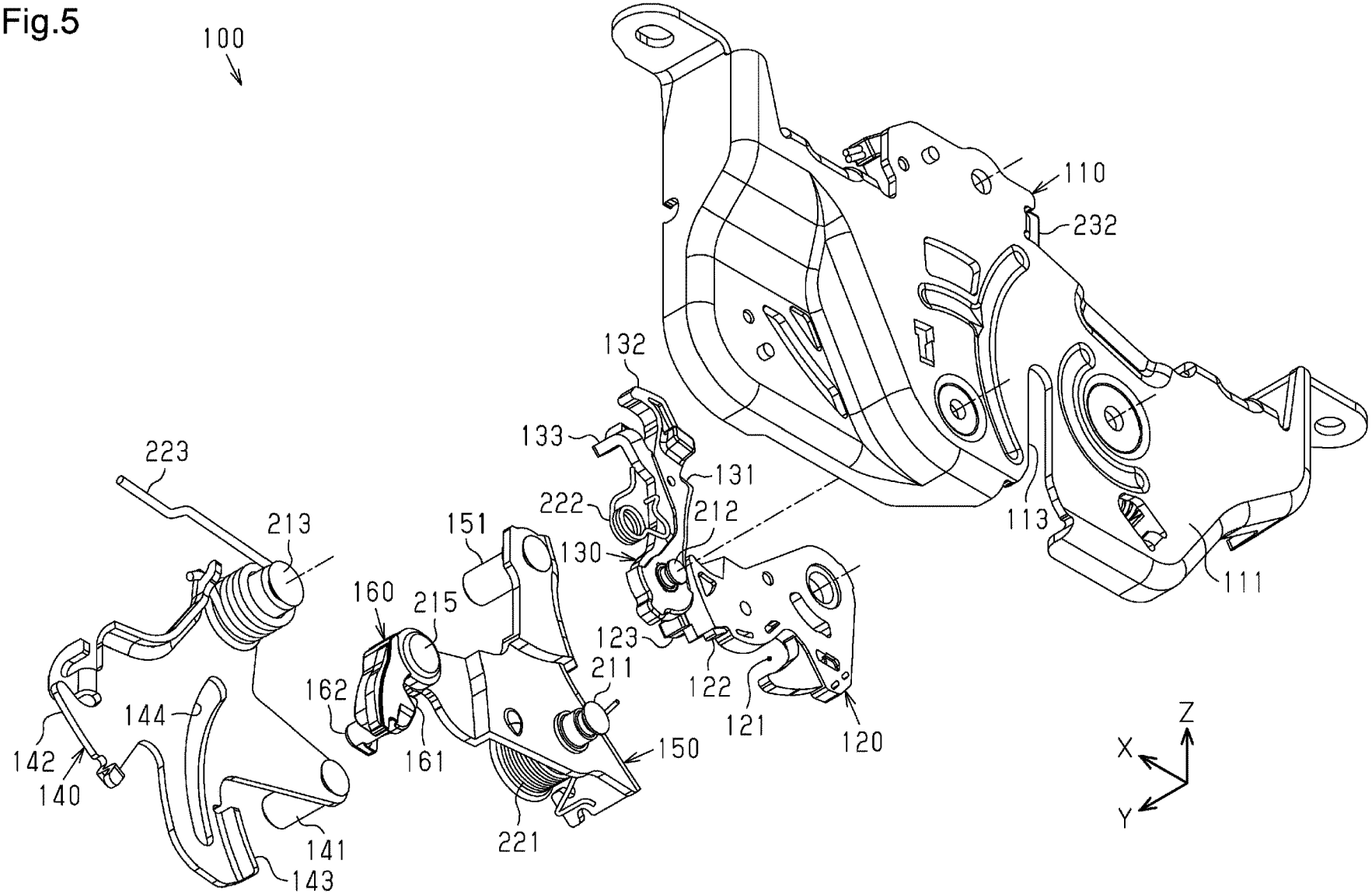
FIG. 5 is an exploded perspective view of the lock device.

As shown in FIGS. 4 and 5, the lock device 100 includes a latch spring 221 that urges the latch 120, a pawl spring 222 that urges the pawl 130, an open lever spring 223 that urges the open lever 140, and a close lever spring 224 that urges the close lever 150.

As shown in FIGS. 2 and 3, the lock device 100 includes a latch stopper 231 that positions the latch 120, a close lever stopper 232 that positions the close lever 150, a pawl switch 241 that detects the position of the pawl 130, an open lever switch 242 that detects the position of the open lever 140, and a drive lever switch 243 that detects the position of the drive lever 170.

As shown in FIG. 2, the housing 110 includes a first plate 111 and a second plate 112 that extends in a direction intersecting the first plate 111. In the present embodiment, the housing 110 is formed by bending a portion corresponding to the second plate 112 from a portion corresponding to the first plate 111. In the present embodiment, the angle between the first plate 111 and the second plate 112 is substantially ninety degrees.

The first plate 111 includes a slot 113 extending toward the second plate 112. The slot 113 is a groove through which the striker 23 moves when the cover 50 is located at the fully closed position and in the proximity of the fully closed position. As shown in FIGS. 2 and 3, the first plate 111 supports the latch support shaft 211, the pawl support shaft 212, and the open lever support shaft 213. The axial direction of each of the latch support shaft 211, the pawl support shaft 212, and the open lever support shaft 213 extends in the thickness-wise direction of the first plate 111. The latch support shaft 211 is supported by a portion of the first plate 111 located at one side of the slot 113. The pawl support shaft 212 and the open lever support shaft 213 are supported by a portion of the first plate 111 located at the other side of the slot 113. In other words, in a front view of the first plate 111, the slot 113 is located between the latch support shaft 211 and the pawl support shaft 212 and between the latch support shaft 211 and the open lever support shaft 213.

As shown in FIG. 2, the second plate 112 includes a first communication hole 114 that is open in a position close to the first plate 111 and a second communication hole 115 that is open in a position farther from the first plate 111 than the first communication hole 114. The first communication hole 114 allows the levers to be arranged without interfering with the second plate 112. The second communication hole 115 allows components of the lock driver 180 to be arranged without interfering with the second plate 112. The second plate 112 supports the lock driver 180 and the drive lever support shaft 214. In this state, the axial direction of the drive lever support shaft 214 extends in the thickness-wise direction of the second plate 112. In a plan view of the second plate 112, the drive lever support shaft 214 is located between the first communication hole 114 and the second communication hole 115.

Figure 6:
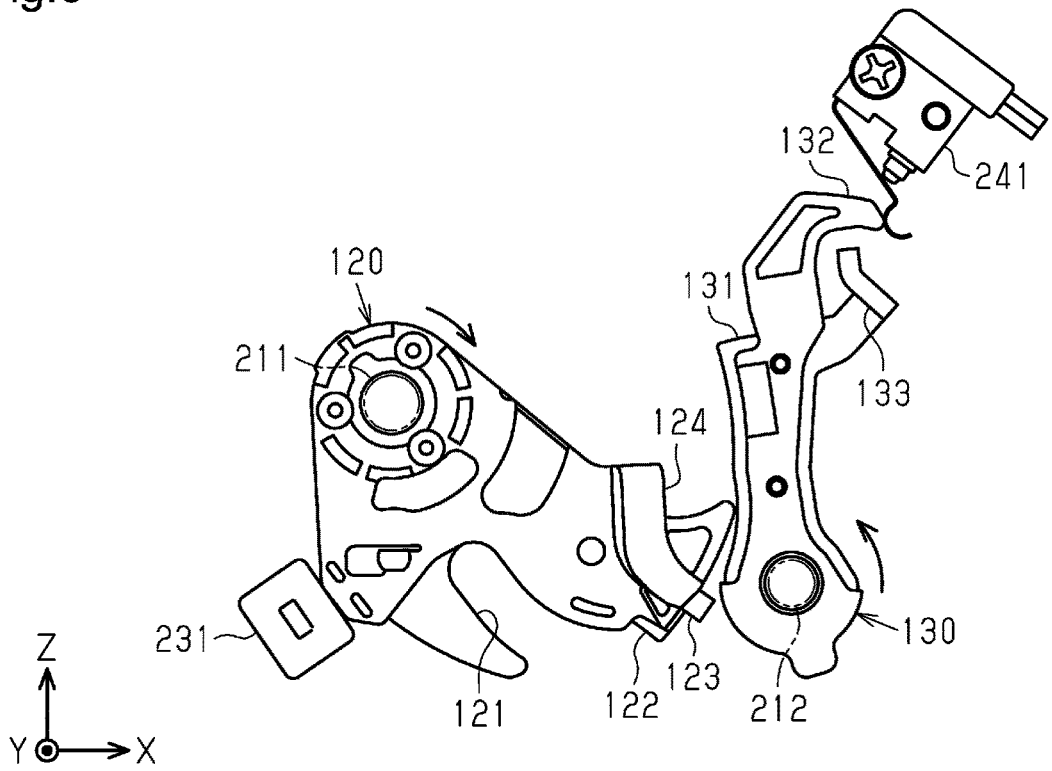
FIG. 6 is a front view showing a pawl and a latch of the lock device.

As shown in FIGS. 4, 5, and 6, the latch 120 has the form of an elliptical plate. The latch 120 includes an engaging groove 121 extending from an outer side surface of the latch 120 toward the rotation axis of the latch 120. The latch 120 includes a first hook 122 on which the pawl 130 hooks, a second hook 123 on which the interlock lever 160 hooks, and a protrusion wall 124 extending in the rotation axis of the latch 120.

During the closing action of the cover 50, the striker 23 enters the engaging groove 121. The first hook 122, the second hook 123, and the protrusion wall 124 are arranged at positions separate from the rotation axis of the latch 120. The first hook 122 and the second hook 123 are arranged at different positions in the rotation direction of the latch 120. The second hook 123 extends from the protrusion wall 124 in a direction orthogonal to the rotation axis of the latch 120. Therefore, the first hook 122 and the second hook 123 are arranged at different positions in the thickness-wise direction of the latch 120.

As shown in FIGS. 4 and 5, the latch 120 is supported by the latch support shaft 211 on the first plate 111 of the housing 110. In this state, the latch 120 overlaps the slot 113 in the thickness-wise direction of the first plate 111. The rotation axis of the latch 120 extends through the center of the latch support shaft 211. As shown in FIG. 6, the latch 120 is urged by the latch spring 221 in a direction indicated by the solid arrow. The urging direction of the latch spring 221 conforms to a direction in which the striker 23 is discharged from the engaging groove 121. In the state shown in FIG. 6, the latch 120 is urged by the latch spring 221 to contact the latch stopper 231 and be positioned at the unlatch position.

As shown in FIGS. 4, 5, and 6, the pawl 130 is plate-shaped and has a longitudinal direction that is orthogonal to the rotation axis of the pawl 130. The pawl 130 includes a first hook 131 that hooks on the first hook 122 of the latch 120, a switch operating portion 132 that operates the pawl switch 241, and an engaging piece 133 that engages the interlock lever 160. The rotation axis of the pawl 130 is located at a proximal end of the pawl 130. The first hook 131, the switch operating portion 132, and the engaging piece 133 are located toward a distal end of the pawl 130. When the latch 120 is located at the full latch position, the first hook 131 hooks on the first hook 122 of the latch 120 to hold the latch 120 at the full latch position. The switch operating portion 132 pushes the pawl switch 241 and separates from the pawl switch 241 in accordance with rotation of the pawl 130.

As shown in FIGS. 4 and 5, the pawl 130 is supported by the pawl support shaft 212 on the first plate 111 of the housing 110. That is, the rotation axis of the pawl 130 extends through the center of the pawl support shaft 212. As shown in FIG. 6, the pawl 130 is urged by the pawl spring 222 in a direction indicated by the solid arrow. More specifically, the pawl 130 is urged in a direction in which the first hook 131 approaches the latch 120.

Figure 7:
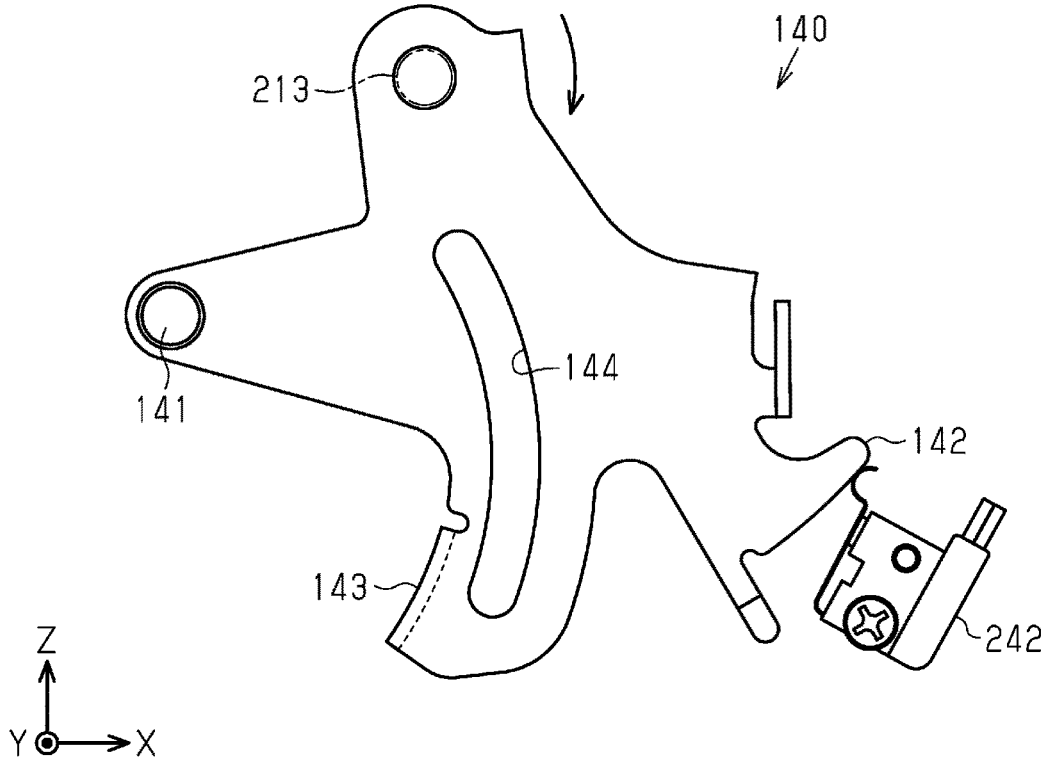
FIG. 7 is a front view showing an open lever of the lock device.

As shown in FIGS. 5, 6, and 7, the open lever 140 is plate-shaped. The open lever 140 includes an open lever pin 141 that is a point of contact with the drive lever 170, a switch operating portion 142 that operates the open lever switch 242, and a contact portion 143 that contacts the second hook 123 of the latch 120. The open lever 140 includes a slide groove 144 extending as an arc.

The open lever pin 141 is cylindrical and extends along the rotation axis of the open lever 140. The open lever pin 141 corresponds to an example of an "open lever engaging portion." The switch operating portion 142 pushes the open lever switch 242 and separates from the open lever switch 242 in accordance with rotation of the open lever 140. The contact portion 143 is arranged close to one of the opposite ends of the slide groove 144 in the extension direction located farther from the rotational axis of the open lever 140. The contact portion 143 extends along the rotation axis of the open lever 140 in a direction opposite to the open lever pin 141.

As shown in FIGS. 5 and 6, the open lever 140 is supported by the open lever support shaft 213 on the first plate 111 of the housing 110. That is, the rotation axis of the open lever 140 extends through the center of the open lever support shaft 213. As shown in FIG. 7, the open lever 140 is urged by the open lever spring 223 in a direction indicated by the solid arrow. In the description hereafter, the direction opposite to the urging direction of the open lever spring 223, that is, the direction opposite to that of the solid arrow shown in FIG. 7, may also be referred to as "the open direction OP."

Figure 8:
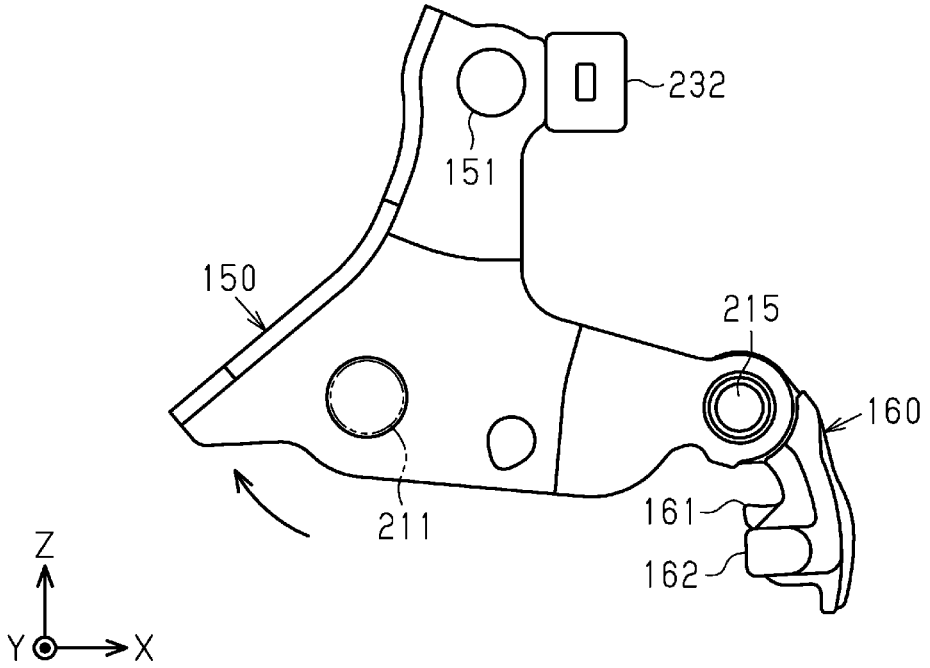
FIG. 8 is a front view showing a close lever and an interlock lever of the lock device.

As shown in FIGS. 4, 5, and 8, the close lever 150 is L-shaped in front view. The close lever 150 is coupled to the interlock lever 160 by the coupling shaft 215 so that the close lever 150 is rotatable relative to the interlock lever 160. The close lever 150 includes a close lever pin 151 that is a point of contact with the drive lever 170. The close lever pin 151 is cylindrical and extends along the rotation axis of the close lever 150. The close lever pin 151 corresponds to an example of a "close lever engaging portion." In the close lever 150, the close lever pin 151 and the coupling shaft 215 are arranged at separate positions in the rotation direction of the close lever 150.

As shown in FIGS. 4 and 5, the close lever 150 is supported together with the latch 120 by the latch support shaft 211 on the first plate 111 of the housing 110. More specifically, the rotation axis of the close lever 150 extends through the center of the latch support shaft 211. As shown in FIG. 8, the close lever 150 is urged by the close lever spring 224 in a direction indicted by the solid arrow. The urging direction of the close lever spring 224 conforms to the urging direction of the latch spring 221. In the description hereafter, the direction opposite to the urging direction of the close lever spring 224, that is, the direction opposite to that of the solid arrow shown in FIG. 8, may also be referred to as "the close direction CL."

As shown in FIGS. 4, 5, and 8, the interlock lever 160 has the form of a rod having a longitudinal direction that is orthogonal to the rotation axis of the interlock lever 160. The interlock lever 160 includes a second hook portion 161 that hooks on the second hook 123 of the latch 120 and a slide shaft 162 that slides on the open lever 140. The rotation axis of the interlock lever 160 is located toward a proximal end of the interlock lever 160. The second hook portion 161 and the slide shaft 162 are located toward a distal end of the interlock lever 160. The second hook portion 161 hooks on the second hook 123 of the latch 120 to hold the latch 120 in a position between the unlatch position and the full latch position. The slide shaft 162 extends in the axial direction of the coupling shaft 215. The slide shaft 162 is inserted into the slide groove 144 of the open lever 140. Since the close lever 150 is urged by the close lever spring 224, the interlock lever 160 that is coupled to the close lever 150 is urged by the close lever spring 224.

Figure 9:
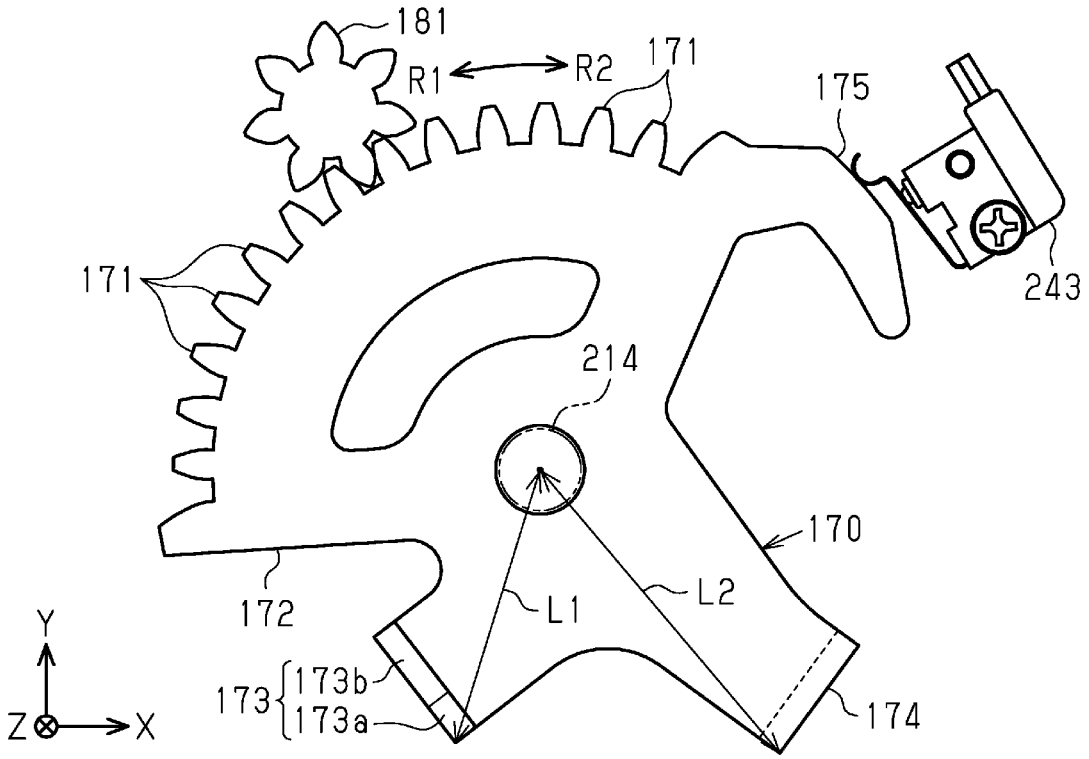
FIG. 9 is a front view showing a drive lever and a driven gear of the lock device.

As shown in FIGS. 2 and 9, the drive lever 170 includes a sector gear 172 including external teeth 171 arranged in the circumferential direction, an open lever pushing portion 173 that pushes the open lever pin 141 of the open lever 140, a close lever pushing portion 174 that pushes the close lever pin 151 of the close lever 150, and a switch operating portion 175 that operates the drive lever switch 243.

The open lever pushing portion 173 and the close lever pushing portion 174 are flat. The open lever pushing portion 173 and the close lever pushing portion 174 extend in opposite directions along the rotation axis of the drive lever 170. In the present embodiment, the open lever pushing portion 173 and the close lever pushing portion 174 extend in the same direction as the rotation axis of the drive lever 170. However, the open lever pushing portion 173 and the close lever pushing portion 174 may extend in a direction that is inclined from the rotation axis of the drive lever 170. The open lever pushing portion 173 pushes the open lever pin 141 when the drive lever 170 rotates in a first direction R1. The close lever pushing portion 174 pushes the close lever pin 151 when the drive lever 170 rotates in a second direction R2.

The open lever pushing portion 173 includes a first pushing part 173*a* and a second pushing part 173*b*. The first pushing part 173*a* includes a flat surface that intersects the rotation axis of the drive lever 170. The second pushing part 173*b* includes a flat surface that is orthogonal to the rotation axis of the drive lever 170. More specifically, when the direction in which the open lever pushing portion 173 extends conforms to the height-wise direction, the height of the first pushing part 173*a* is not constant, whereas the height of the second pushing part 173*b* is constant. The height of the first pushing part 173*a* decreases at a constant rate as the first pushing part 173*a* extends away from the second pushing part 173*b*. In the present embodiment, the angle between the first pushing part 173*a* and the second pushing part 173*b* is substantially one hundred and twenty degrees. The close lever pushing portion 174 includes a structure corresponding to the first pushing part 173*a* of the open lever pushing portion 173 but does not include a structure corresponding to the second pushing part 173*b* of the open lever pushing portion 173. In another embodiment, the close lever pushing portion 174 may include a structure corresponding to the second pushing part 173*b* of the open lever pushing portion 173.

As shown in FIG. 9, length L1 from the rotational center of the drive lever 170 to the open lever pushing portion 173 differs from length L2 from the rotational center of the drive lever 170 to the close lever pushing portion 174. More specifically, the length L1 from the rotational center of the drive lever 170 to the open lever pushing portion 173 is less than the length L2 from the rotational center of the drive lever 170 to the close lever pushing portion 174. The reference position of the open lever pushing portion 173 for the length L1 is a position at which the open lever pushing portion 173 pushes the open lever pin 141. The reference position of the close lever pushing portion 174 for the length L2 is a position at which the close lever pushing portion 174 pushes the close lever pin 151. However, the position at which the open lever pushing portion 173 pushes the open lever pin 141 changes in accordance with rotation of the drive lever 170. FIG. 9 shows the maximum length L1.

The switch operating portion 175 is arranged at a position next to the external teeth 171 of the sector gear 172 in the circumferential direction. The switch operating portion 175 pushes the drive lever switch 243 and separates from the drive lever switch 243 in accordance with rotation of the drive lever 170. In the description hereafter, as shown in FIG. 9, the position of the drive lever 170 when the switch operating portion 175 pushes the drive lever switch 243 may be also referred to as "the neutral position." When the drive lever 170 rotates from the neutral position in the first direction R1 or the second direction R2, the switch operating portion 175 stops pushing the drive lever switch 243.

As shown in FIG. 2, the drive lever 170 is rotationally supported by the drive lever support shaft 214 on a front side of the second plate 112 of the housing 110. More specifically, the rotation axis of the drive lever 170 extends through the center of the drive lever support shaft 214. In this state, the open lever pushing portion 173 projects through the first communication hole 114 in the second plate 112 into the space located at a rear side of the second plate 112. The close lever pushing portion 174 projects into the space located at the front side of the second plate 112.

Figure 10:
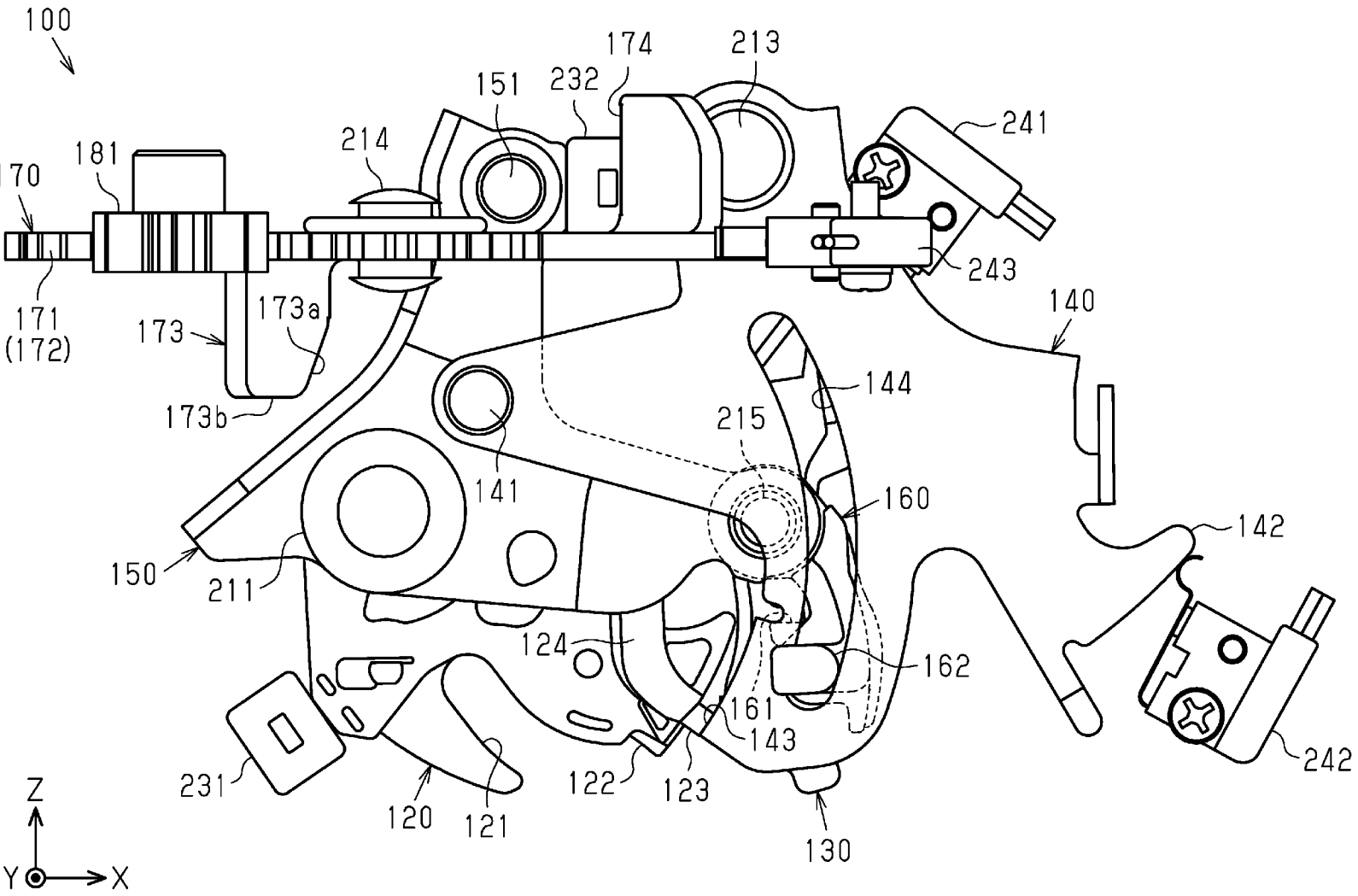
FIG. 10 is a plan view showing a positional relationship between major components of the lock device.
Figure 11:
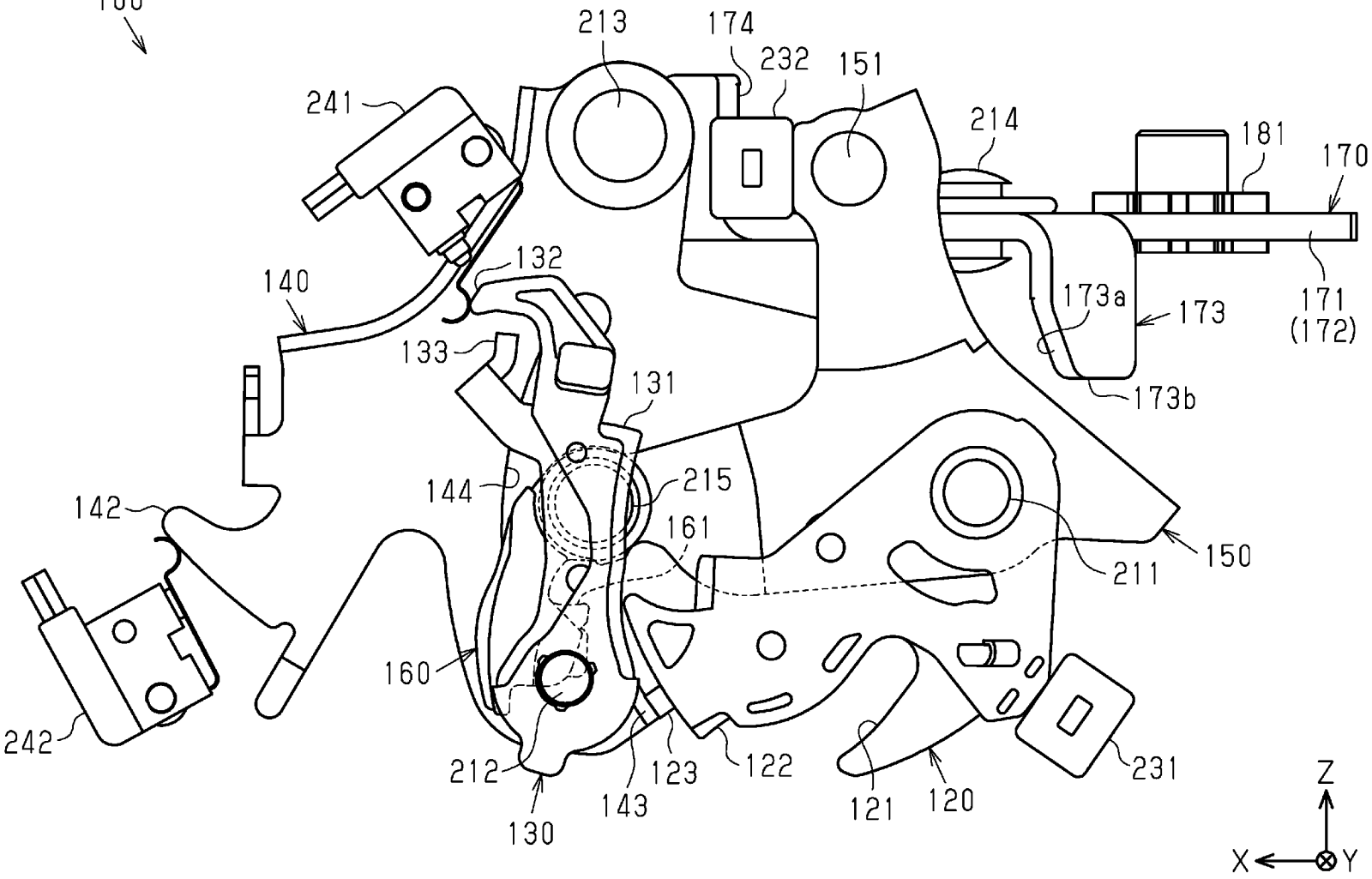
FIG. 11 is a bottom view showing a positional relationship between major components of the lock device.
Figure 12:
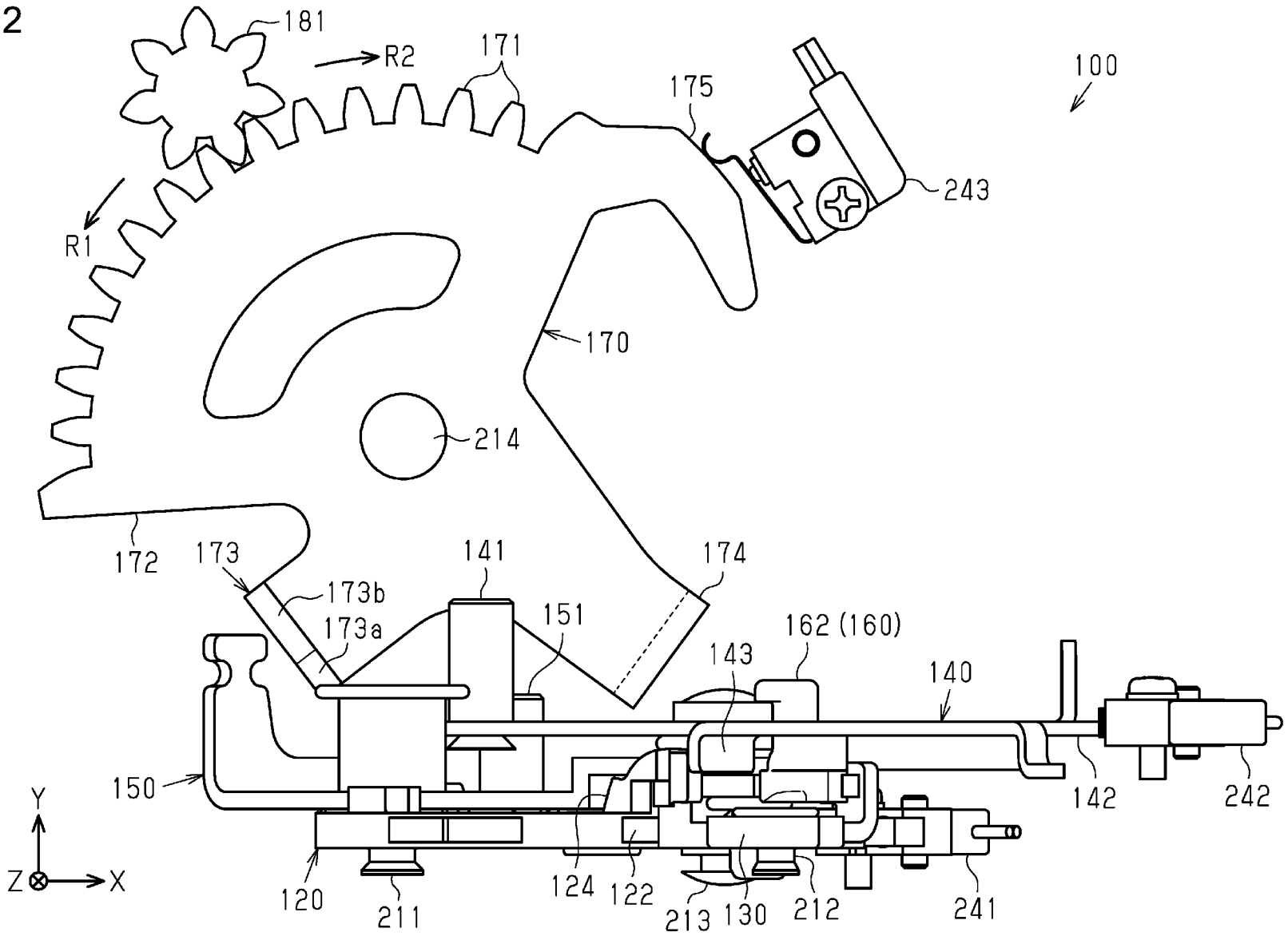
FIG. 12 is a front view showing a positional relationship between major components of the lock device.

The positional relationship and the engagement relationship between major components of the lock device 100 with reference to FIGS. 10 to 12.

As shown in FIGS. 10 to 12, in the lock device 100, when the direction in which the open lever pin 141 and the close lever pin 151 extend conforms to the "height-wise direction," the latch 120 and the pawl 130 are located at substantially the same height. The latch 120 and the pawl 130 are located adjacent to each other in a direction orthogonal to the height-wise direction. As shown in FIGS. 10 and 11, when the latch 120 is located at the unlatch position, the pawl 130 is urged by the pawl spring 222 and is positioned by contacting the latch 120.

As shown in FIGS. 10 to 12, the open lever 140 is located at the highest position among the components that are supported by the first plate 111 of the housing 110. However, the contact portion 143 of the open lever 140 extends to the same height as the second hook 123 of the latch 120. Thus, the contact portion 143 is contactable with the second hook 123. More specifically, as shown in FIGS. 10 and 11, when the latch 120 is located at the unlatch position, the open lever 140 is urged by the open lever spring 223 and is positioned by contacting the second hook 123 of the latch 120. The center of the arc-shaped slide groove 144 of the open lever 140 is located close to the rotation axis of the open lever 140.

As shown in FIGS. 10 to 12, in the height-wise direction, the close lever 150 is located at a position that is higher than the latch 120 and the pawl 130 and is lower than the open lever 140. As shown in FIGS. 10 and 11, when the latch 120 is located at the unlatch position, the close lever 150 is disengaged from the latch 120, the pawl 130, and the open lever 140. When the latch 120 is located at the unlatch position, the close lever 150 is urged by the close lever spring 224 and is positioned by contacting the close lever stopper 232.

As shown in FIGS. 10 to 12, in the height-wise direction, the interlock lever 160 is located between the pawl 130 and the close lever 150. However, the second hook 123 of the latch 120 and the interlock lever 160 are located at the same height. This allows the second hook portion 161 of the interlock lever 160 to hook on the second hook 123 of the latch 120. Also, the engaging piece 133 of the pawl 130 and the interlock lever 160 are located at the same height. This allows the interlock lever 160 to push the engaging piece 133 of the pawl 130. In addition, as shown in FIGS. 10 and 11, the slide shaft 162 of the interlock lever 160 is inserted through the slide groove 144 in the open lever 140. With this configuration, when the open lever 140 rotates, the interlock lever 160 moves in the rotation direction of the open lever 140. When the close lever 150 rotates, the slide shaft 162 of the interlock lever 160 moves along the slide groove 144 in the open lever 140. Therefore, when the interlock lever 160 moves in accordance with rotation of the close lever 150, the open lever 140 does not rotate.

As shown in FIGS. 10 to 12, the rotation axis of the latch 120, the rotation axis of the pawl 130, the rotation axis of the open lever 140, and the rotation axis of the close lever 150 extend in the same direction. The rotation axis of the latch 120, the rotation axis of the pawl 130, the rotation axis of the open lever 140, and the rotation axis of the close lever 150 extend in a direction different from the direction in which the rotation axis of the drive lever 170 extends. In other words, the rotation axis of the latch 120, the rotation axis of the pawl 130, the rotation axis of the open lever 140, and the rotation axis of the close lever 150 are skewed with respect to the rotation axis of the drive lever 170. In the present embodiment, as shown in FIGS. 10 to 12, the rotation axis of the latch 120, the rotation axis of the pawl 130, the rotation axis of the open lever 140, and the rotation axis of the close lever 150 extend along the y-axis. The rotation axis of the drive lever 170 extends along the z-axis. As viewed in a direction of an x-axis, which is orthogonal to the y-axis and the z-axis, the rotation axis of the latch 120, the rotation axis of the pawl 130, the rotation axis of the open lever 140, and the rotation axis of the close lever 150 are orthogonal to the rotation axis of the drive lever 170. The positional relationship of the rotation axis of the drive lever 170 with the rotation axis of the latch 120, the rotation axis of the pawl 130, the rotation axis of the open lever 140, and the rotation axis of the close lever 150 changes in accordance with the angle between the first plate 111 and the second plate 112.

As shown in FIGS. 10 and 12, in the direction in which the rotation axis of the drive lever 170 extends, the rotation axis of the open lever 140 and the rotation axis of the close lever 150 are located at opposite sides of the drive lever 170. In other words, in the direction in which the rotation axis of the drive lever 170 extends, the open lever support shaft 213 and the latch support shaft 211 are located at opposite sides of the drive lever 170. In the direction in which the rotation axis of the drive lever 170 extends, the close lever pin 151 and the open lever pin 141 are located at opposite sides of the sector gear 172. Although positions of the open lever pin 141 and the close lever pin 151 change in accordance with rotation of the open lever 140 and the close lever 150, the relationship described above is maintained.

As shown in FIGS. 10 and 12, the open lever pin 141 extends toward a rotation path of the open lever pushing portion 173 when the drive lever 170 rotates in the first direction R1 from the neutral position. The close lever pin 151 extends toward a rotation path of the close lever pushing portion 174 when the drive lever 170 rotates in the second direction R2 from the neutral position. The open lever pin 141 and the close lever pin 151 have the same length in the axial direction. The open lever 140 is located at a higher position than the close lever 150. Therefore, the open lever pin 141 extends closer to the rotation axis of the drive lever 170 than the close lever pin 151 does. As shown in FIGS. 10 and 12, when the drive lever 170 is located at the neutral position, the open lever pushing portion 173 and the close lever pushing portion 174 are separate from the open lever pin 141 and the close lever pin 151, respectively, in the rotation direction of the drive lever 170.

As shown in FIGS. 10 and 12, the open lever pin 141 and the close lever pin 151 are located between the rotation axis of the open lever 140 and the rotation axis of the drive lever 170. In other words, the open lever pin 141 and the close lever pin 151 are located between the open lever support shaft 213 and the latch support shaft 211. As shown in FIG. 12, as viewed in the direction in which the rotation axis of the drive lever 170 extends, the open lever pin 141 and the close lever pin 151 partially overlap each other. However, as shown in FIG. 10, as viewed in the height-wise direction, the open lever pin 141 and the close lever pin 151 are separate from each other.

As shown in FIG. 2, the lock driver 180 includes a drive gear 181 configured to mesh with the sector gear 172 of the drive lever 170, a motor 182 used as a drive source for the drive gear 181, and a casing 183 to which the drive gear 181 and the motor 182 are coupled. Although not shown in the drawings, the lock driver 180 has a speed reducer that increases output torque of the motor 182 and transmits the torque to the drive gear 181.

The lock driver 180 is fixed from the rear side of the second plate 112 using a fastening member such as a screw. In this case, the drive gear 181 is located at the front side of the second plate 112 through the second communication hole 115 in the housing 110. The drive gear 181 meshes with the external teeth 171 on the sector gear 172 of the drive lever 170 supported by the front side of the second plate 112. The drive gear 181 rotates the drive lever 170 in the first direction R1 and the second direction R2 in accordance with rotation directions. In the present embodiment, forward rotation of the motor 182 rotates the drive lever 170 in the first direction R1, and reverse rotation of the motor 182 rotates the drive lever 170 in the second direction R2.

The configuration related to control of the present embodiment will now be described.

When the user operates a button provided on a portable device such as an electronic key or when the user operates a button provided in the vicinity of the driver seat, the controller 300 receives an actuation request signal of the roof 30. The controller 300 also receives a pawl position recognition signal, an open lever position recognition signal, and a drive lever position recognition signal that indicate activation-deactivation states of the pawl switch 241, the open lever switch 242, and the drive lever switch 243, respectively. In the present embodiment, the pawl position recognition signal is activated when the pawl switch 241 is pushed, and is deactivated when the pawl switch 241 is not pushed. The open lever position recognition signal is activated when the open lever switch 242 is pushed, and is deactivated when the open lever switch 242 is not pushed. The drive lever position recognition signal is deactivated when the drive lever switch 243 is pushed, and is activated when the drive lever switch 243 is not pushed.

The controller 300 determines whether an actuation request of the roof 30 is received from the user based on presence and absence of the actuation request signal. When the actuation request signal is received, the controller 300 uses the cover driver 60 to open the cover 50 from the fully closed position toward the fully open position. Subsequently, the controller 300 uses the roof driver 40 to store or deploy the roof 30. After the storing action or deploying action of the roof 30 is completed, the controller 300 uses the cover driver 60 to close the cover 50 from the fully open position toward the fully closed position.

When the cover driver 60 closes the cover 50 to the proximity of the fully closed position, the controller 300 uses the lock driver 180 to perform an "closing action" that rotates the latch 120 to the full latch position. The controller 300 hooks the latch 120 on the striker 23 and restrains the cover 50 in the fully closed position. When the cover driver 60 starts to open the cover 50, the controller 300 uses the lock driver 180 to perform an "open action" that rotates the latch 120 to the unlatch position. As a result, the controller 300 unhooks the latch 120 from the striker 23 and releases the cover 50 from restraint at the fully closed position. During the closing action and the open action, the controller 300 determines when to forwardly rotate the motor 182, reversely rotate the motor 182, and stop the motor 182 based on the switching of the activation-deactivation states of the pawl position recognition signal, the open lever position recognition signal, and the drive lever position recognition signal.

The operation of the present embodiment will now be described.

First, the operation of the lock device 100 during the closing action will be described.

Figure 13:
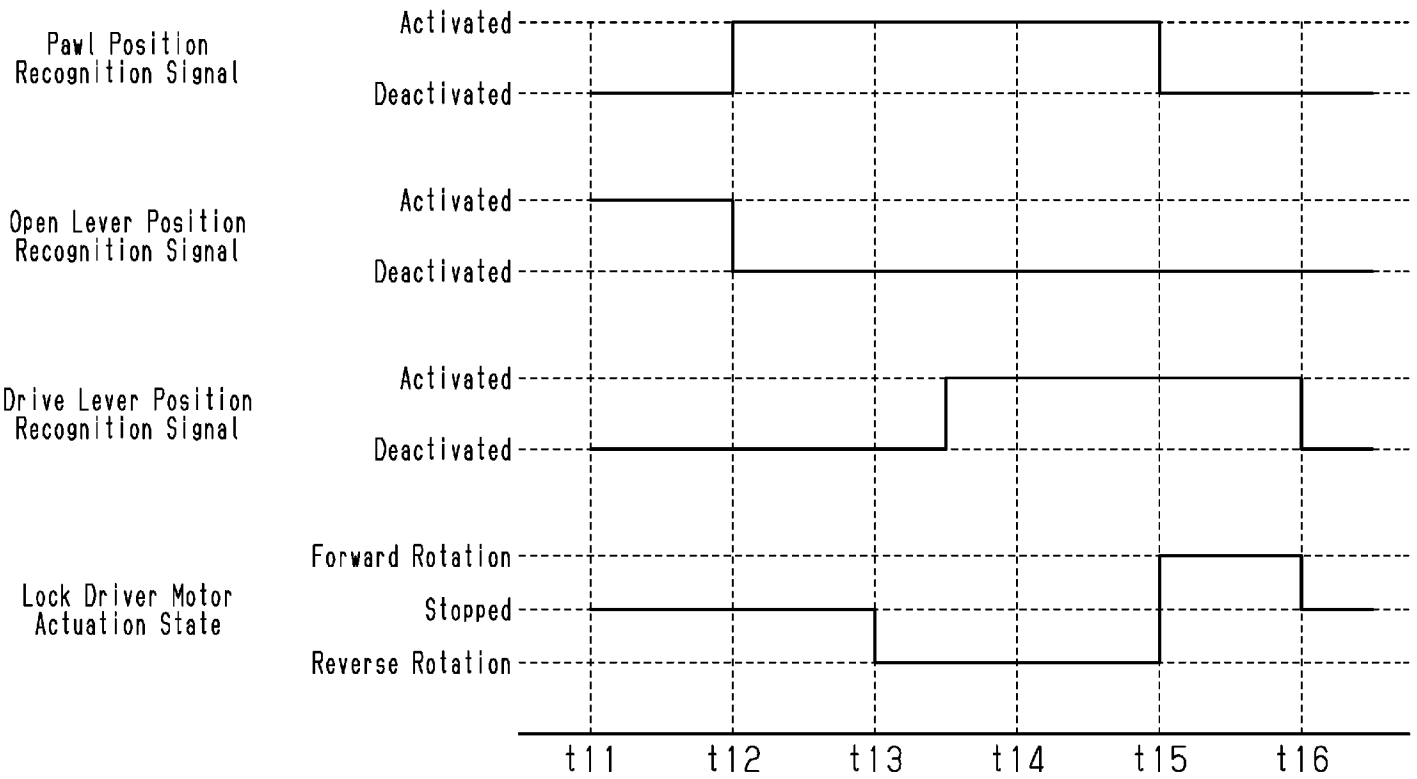
FIG. 13 is a timing chart showing changes in each signal and motor driving mode during a closing action of an opening-closing body.

FIG. 13 is a timing chart showing the activation-deactivation states of the recognition signals and the actuation state of the motor 182 during the closing action. FIGS. 14 to 23 show states of the lock device 100 corresponding to one of the timings shown in FIG. 13. In FIGS. 14 to 23, some of the components of the lock device 100 are simplified to facilitate the understanding.

Figure 14:
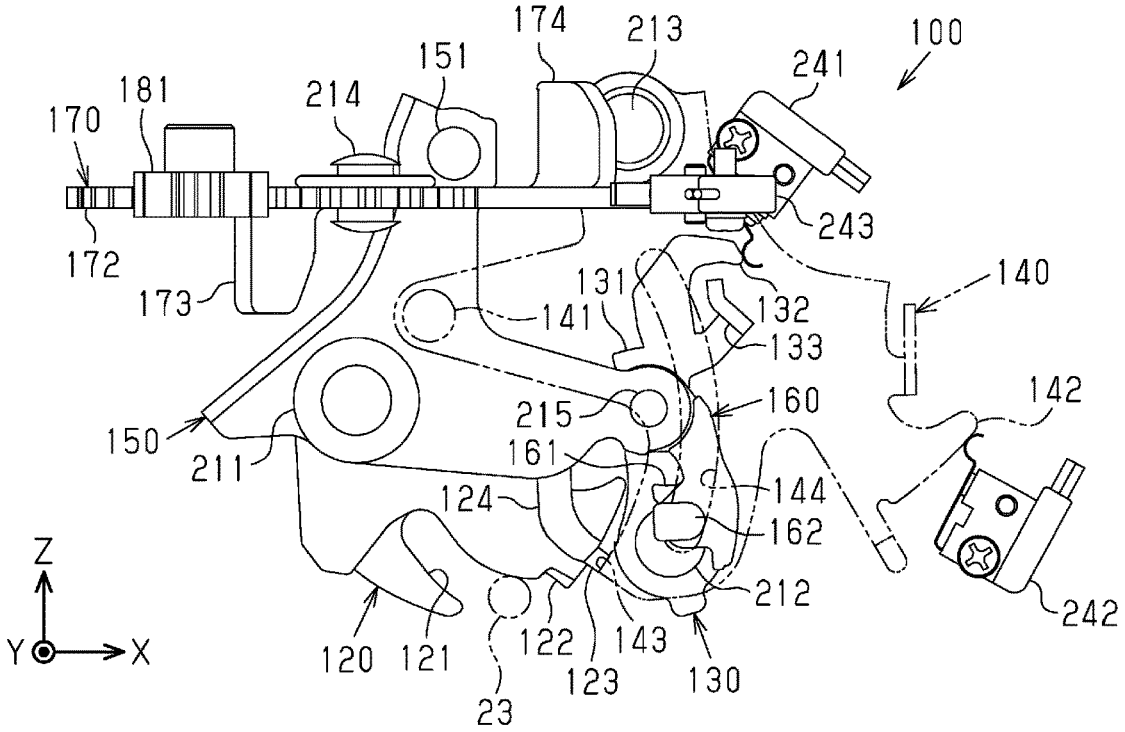
FIG. 14 is a plan view of the lock device when the latch is located at an unlatch position.
Figure 15:
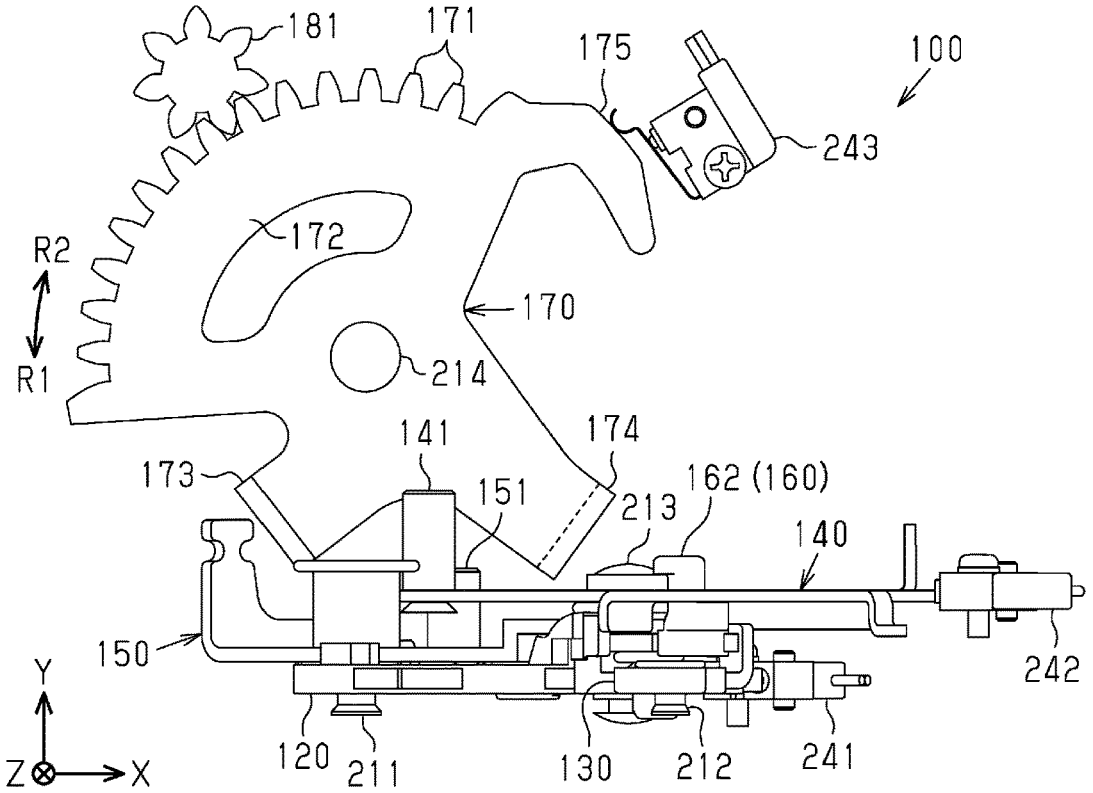
FIG. 15 is a front view of the lock device when the latch is located at the unlatch position.

FIGS. 14 and 15 show a state of the lock device 100 at first timing t11, at which the cover driver 60 closes the cover 50 to the proximity of the fully closed position.

As shown in FIGS. 14 and 15, when closing the cover 50, the latch 120 is located at the unlatch position until the latch 120 comes into contact with the striker 23. When the latch 120 is located at the unlatch position, the pawl 130 is separate from the pawl switch 241. Thus, at first timing t11, the pawl position recognition signal is deactivated.

The close lever 150 is urged by the close lever spring 224, and the close lever 150 is partially in contact with the close lever stopper 232, which is shown in FIG. 11. The open lever 140 is urged by the open lever spring 223, and the contact portion 143 is in contact with the second hook 123 of the latch 120. At first timing t11, the open lever 140 pushes the open lever switch 242, and the open lever position recognition signal is activated. As shown in FIG. 15, the drive lever 170 is located at the neutral position. At first timing t11, the drive lever 170 pushes the drive lever switch 243, and the drive lever position recognition signal is deactivated. At first timing t11, the motor 182 of the lock driver 180 is stopped.

Figure 16:
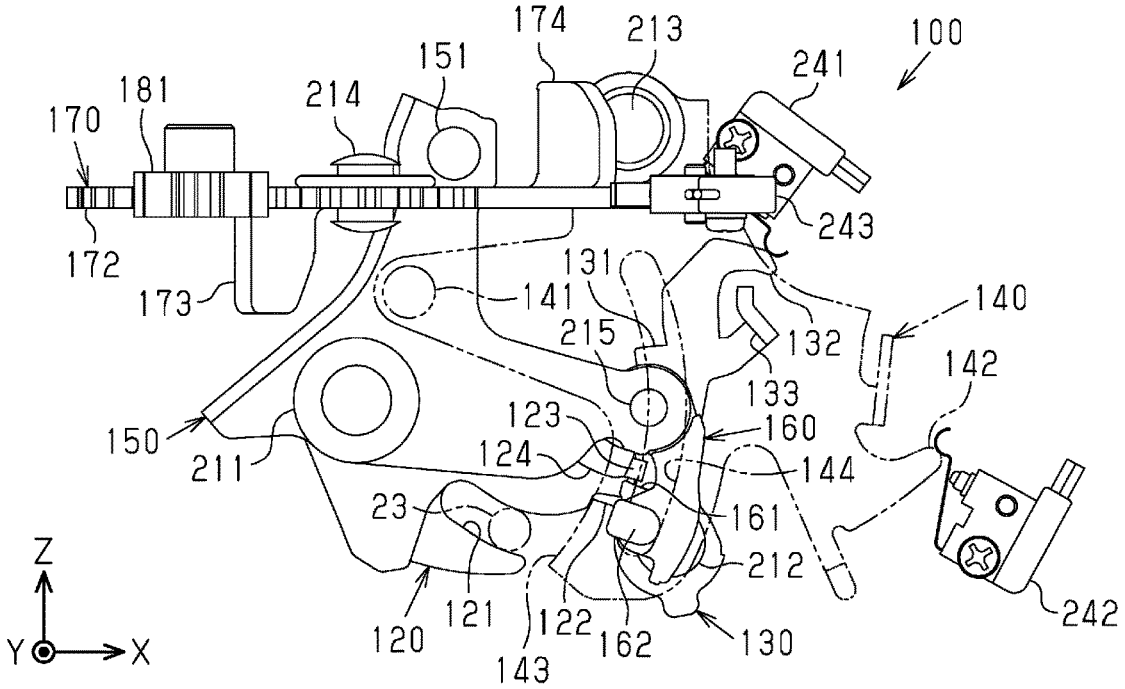
FIG. 16 is a plan view of the lock device when the latch is located at an action switching position.
Figure 17:
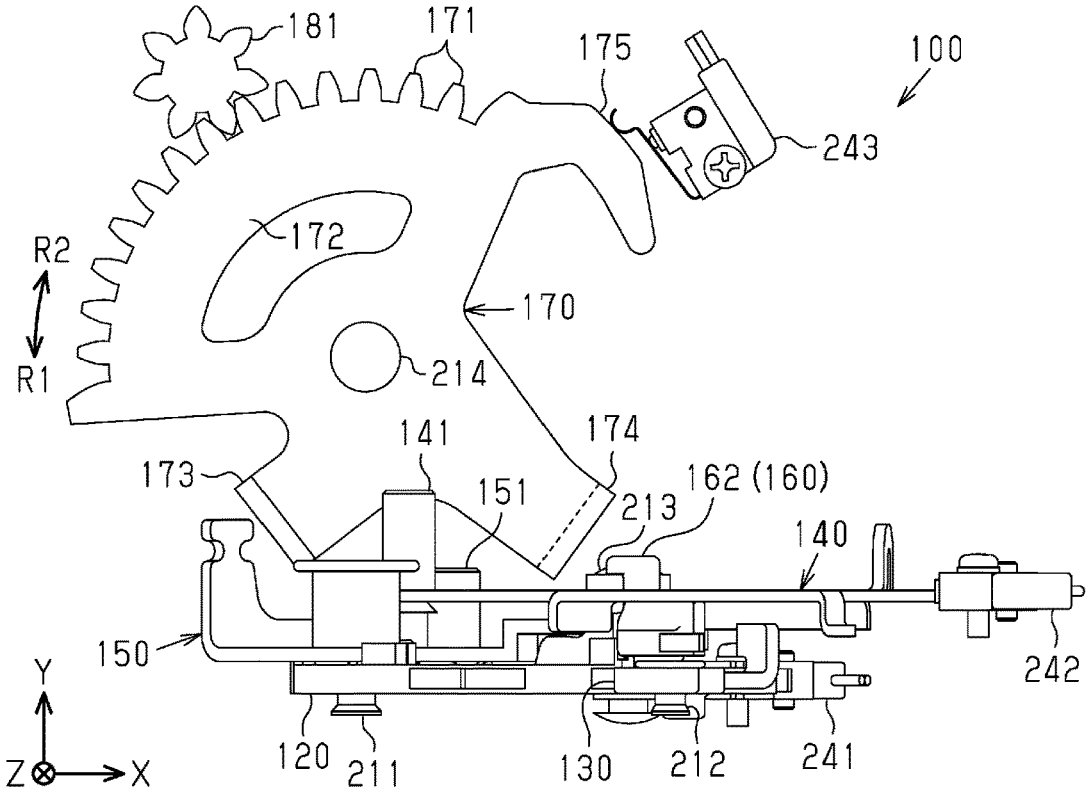
FIG. 17 is a front view of the lock device when the latch is located at the action switching position.

FIGS. 16 and 17 show a state of the lock device 100 at second timing t12, at which the closing of the cover 50 is advanced from first timing t11.

As shown in FIGS. 16 and 17, when the closing of the cover 50 is advanced, as the striker 23 pushes the latch 120, the striker 23 starts to enter the engaging groove 121 of the latch 120. At this time, the latch 120 rotates in the direction opposite to the urging direction of the latch spring 221. The latch 120 is located at an "action switching position" shown in FIG. 16.

The pawl 130 rotates in the direction opposite to the urging direction of the pawl spring 222 in accordance with rotation of the latch 120. As a result, the pawl 130 pushes the pawl switch 241, and the pawl position recognition signal is activated at second timing t12. The close lever 150 does not rotate in accordance with rotation of the latch 120.

The contact portion 143 of the open lever 140 becomes out of contact with the second hook 123 of the latch 120 in accordance with rotation of the latch 120. Thus, the open lever 140 rotates in the urging direction of the open lever spring 223. As a result, the open lever 140 is separated from the open lever switch 242, and the open lever position recognition signal is deactivated at second timing t12.

When the open lever 140 rotates in the urging direction of the open lever spring 223, the open lever 140 pushes the interlock lever 160 through the slide groove 144. This moves the distal end of the interlock lever 160 in a direction approaching the latch 120. As a result, the second hook portion 161 of the interlock lever 160 hooks on the second hook 123 of the latch 120. In this point, the action switching position shown in FIG. 16 is the position of the latch 120 when the second hook 123 of the latch 120 hooks on the second hook portion 161 of the interlock lever 160. When the latch 120 is located at the action switching position, rotation of the latch 120 toward the unlatch position from the action switching position is restricted. Therefore, after the latch 120 has moved to the action switching position, the striker 23 is not discharged from the engaging groove 121 of the latch 120 even when the force pushing the latch 120 onto the striker 23 is cancelled.

In FIG. 16, since the force pushing the latch 120 onto the striker 23 is applied by the cover driver 60, the second hook 123 of the latch 120 is spaced apart by a slight gap from the second hook portion 161 of the interlock lever 160. However, when the force pushing the latch 120 onto the striker 23 is canceled, the latch 120 rotates in the urging direction of the latch spring 221. Consequently, the second hook 123 of the latch 120 comes into contact with the second hook portion 161 of the interlock lever 160.

At third timing t13, which is next to second timing t12 at which the open lever position recognition signal is deactivated, the lock driver 180 is driven to start the closing action. More specifically, the motor 182 of the lock driver 180 is rotated reversely to rotate the drive lever 170 in the second direction R2. As described above, in the present embodiment, when the latch 120 has rotated to the action switching position, that is, after the open lever position recognition signal is deactivated, the state is switched from a state in which the cover driver 60 is driven to a state in which the lock driver 180 is driven.

Figure 18:
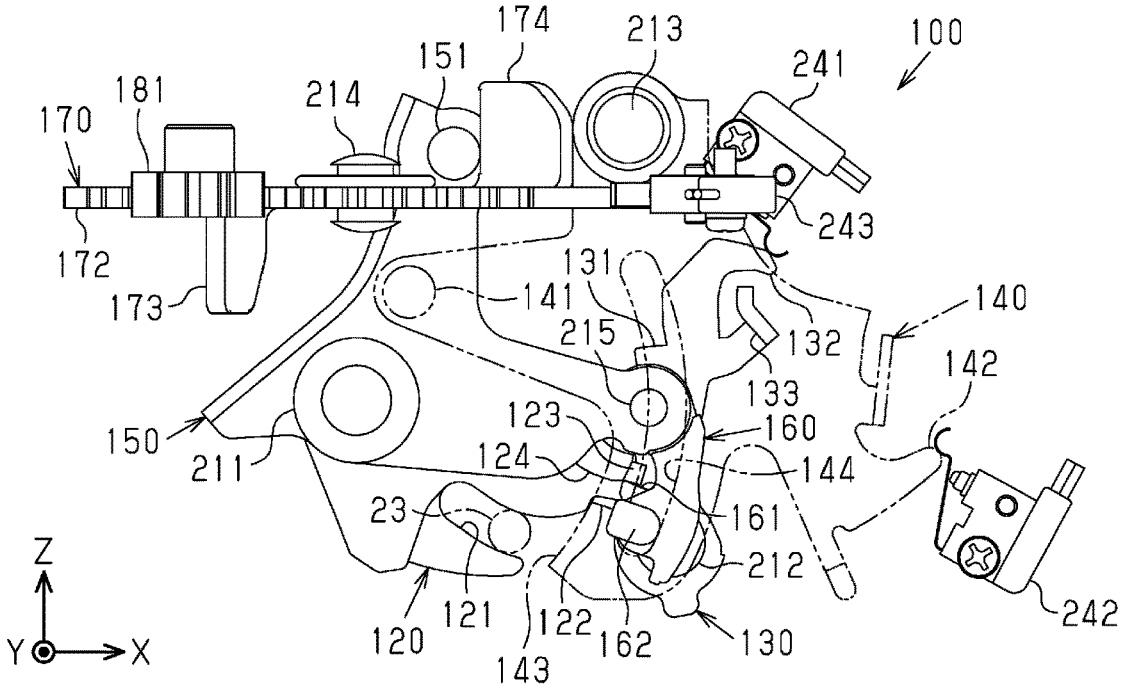
FIG. 18 is a plan view of the lock device when the drive lever is in contact with the close lever.
Figure 19:
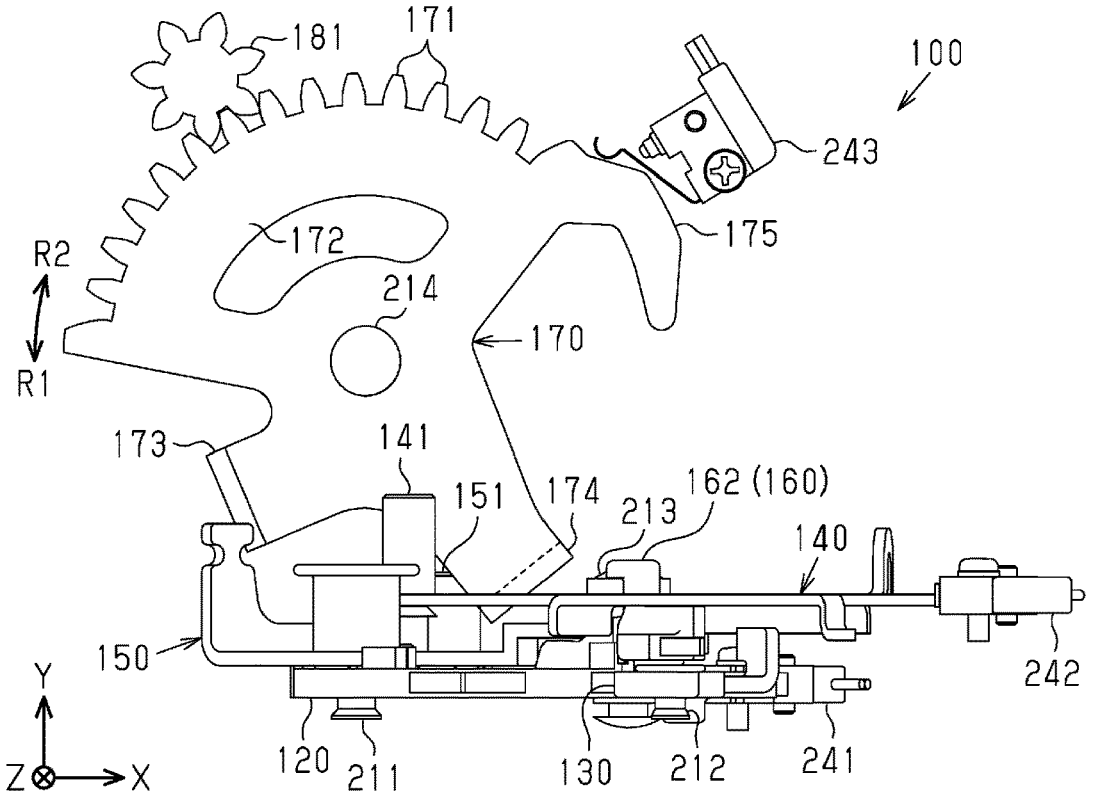
FIG. 19 is a front view of the lock device when the drive lever is in contact with the close lever.

FIGS. 18 and 19 show a state of the lock device 100 at fourth timing t14 at which the motor 182 of the lock driver 180 is rotating reversely.

As shown in FIGS. 18 and 19, when the motor 182 of the lock driver 180 rotates reversely, the drive lever 170 rotates in the second direction R2. This separates the drive lever 170 from the drive lever switch 243. At fourth timing t14, the drive lever position recognition signal is activated. When the drive lever 170 continues to rotate in the second direction R2, the close lever pushing portion 174 comes into contact with the close lever pin 151. At this time, the close lever pushing portion 174 comes into contact with a distal portion of the close lever pin 151. After the close lever pushing portion 174 comes into contact with the close lever pin 151, the close lever 150 rotates in the close direction CL in accordance with the rotation of the drive lever 170 in the second direction R2.

Figure 20:
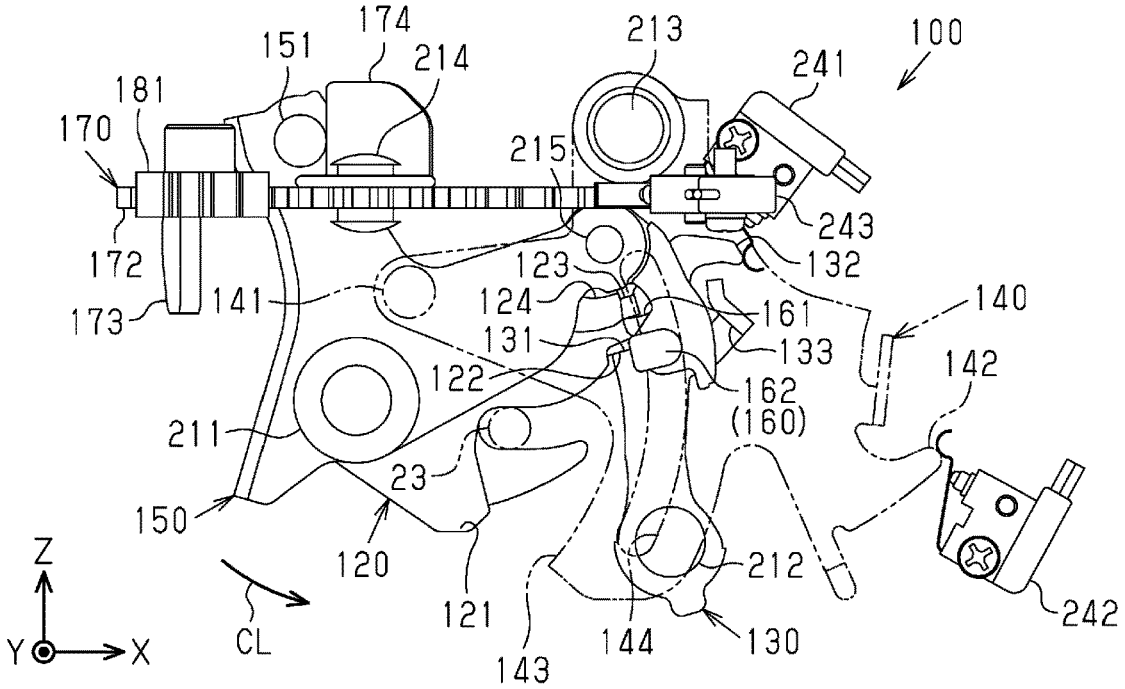
FIG. 20 is a plan view of the lock device when the full latch action is completed.
Figure 21:
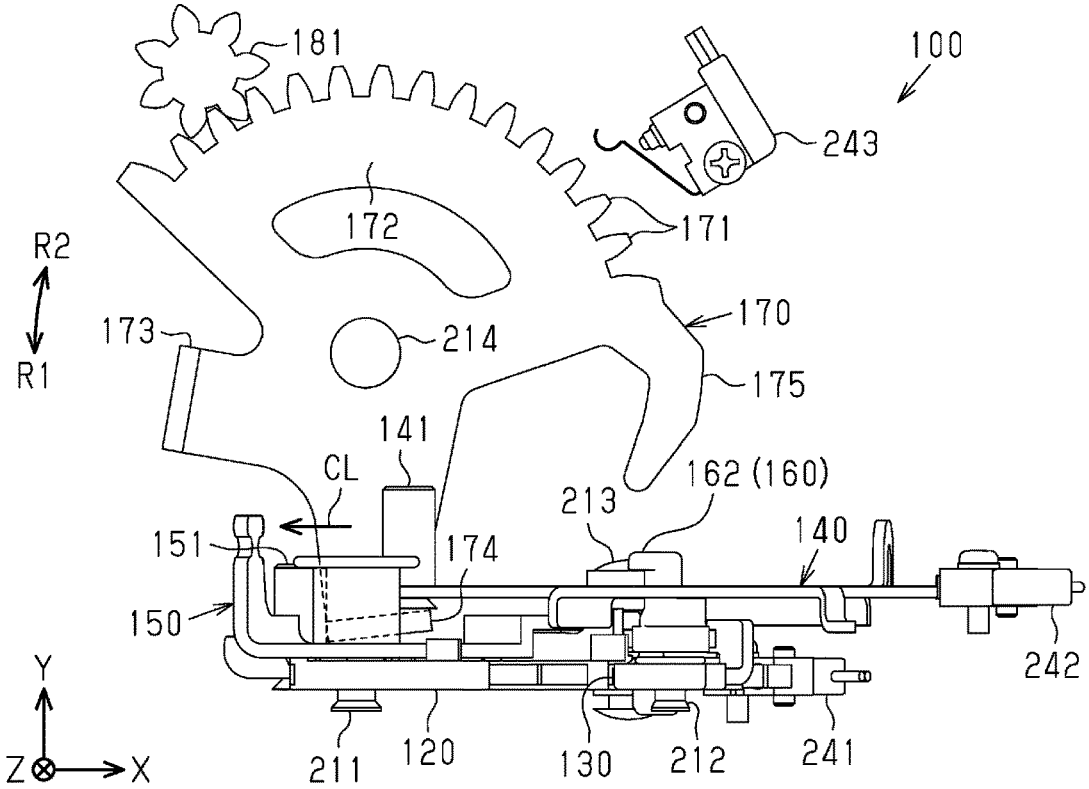
FIG. 21 is a front view of the lock device when the full latch action is completed.

FIGS. 20 and 21 show a state of the lock device 100 at fifth timing t15, at which the pawl position recognition signal is deactivated.

As shown in FIGS. 20 and 21, when the close lever pushing portion 174 of the drive lever 170 pushes the close lever pin 151, the close lever 150 rotates together with the interlock lever 160 in the close direction CL, which is indicated by the solid arrow. Since the slide shaft 162 of the interlock lever 160 is inserted into the slide groove 144 of the open lever 140, the interlock lever 160 moves along the slide groove 144. At this time, the interlock lever 160 moves along the slide groove 144 while the hook state is maintained between the second hook portion 161 of the interlock lever 160 and the second hook 123 of the latch 120. In accordance with the movement of the interlock lever 160, the latch 120 rotates in the direction opposite to the urging direction of the latch spring 221 so as to draw in the striker 23. When the second hook portion 161 of the interlock lever 160 moves beyond the first hook 131 of the pawl 130 in the rotation direction of the latch 120, the first hook 131 of the pawl 130 is allowed to hook on the first hook 122 of the latch 120.

Consequently, as shown in FIG. 20, the latch 120 is located at the full latch position where the latch 120 hooks on the striker 23, and the pawl 130 is located at the hook position where the pawl 130 hooks on the latch 120 located at the full latch position to restrict rotation of the latch 120 toward the unlatch position. In the description hereafter, rotating the latch 120 to the full latch position with the lock driver 180 during the closing action of the cover 50 may also be referred to as "the full latch action."

As shown in FIG. 21, at the point in time of completing the full latch action, the close lever pushing portion 174 is in contact with a proximal portion of the close lever pin 151. As shown in FIGS. 17, 19, and 21, the movement path of the close lever pushing portion 174 in accordance with the closing action is arc-shaped. Thus, in the close lever pin 151, the point of contact with the close lever pushing portion 174 changes from the distal position toward the proximal position as the closing action advances. In addition, as the rotation amount of the latch 120 increases in accordance with the closing action, resilience of the latch spring 221 increases. In this point, increases in the rotation amount of the latch 120 increases the force acting on the close lever pin 151. That is, the force of the close lever pushing portion 174 that pushes the close lever pin 151 is maximal at the point in time of completing the full latch action.

As shown in FIG. 21, when the pawl 130 is located at the hook position, the pawl 130 is separate from the pawl switch 241. Thus, at fifth timing t15, the pawl position recognition signal is deactivated. The deactivation of the pawl position recognition signal at fifth timing t15 indicates that the full latch action of the latch 120 is completed. At fifth timing t15, the rotation direction of the motor 182 of the lock driver 180 is inversed so that the drive lever 170, which has rotated in the second direction R2, returns to the neutral position. That is, the motor 182 of the lock driver 180 is rotated forward.

When the drive lever 170 rotates in the first direction R1 in accordance with the forward rotation of the motor 182 of the lock driver 180, a force acting to rotate the close lever 150 in the close direction CL is not transmitted to the close lever 150. However, since the close lever 150 is in contact with the protrusion wall 124 of the latch 120 positioned at the full latch position, the close lever 150 will not be rotated in the urging direction of the close lever spring 224. At this point, when the latch 120 is located at the full latch position, the second hook portion 161 of the interlock lever 160 is spaced apart by a slight gap from the second hook 123 of the latch 120.

Figure 22:
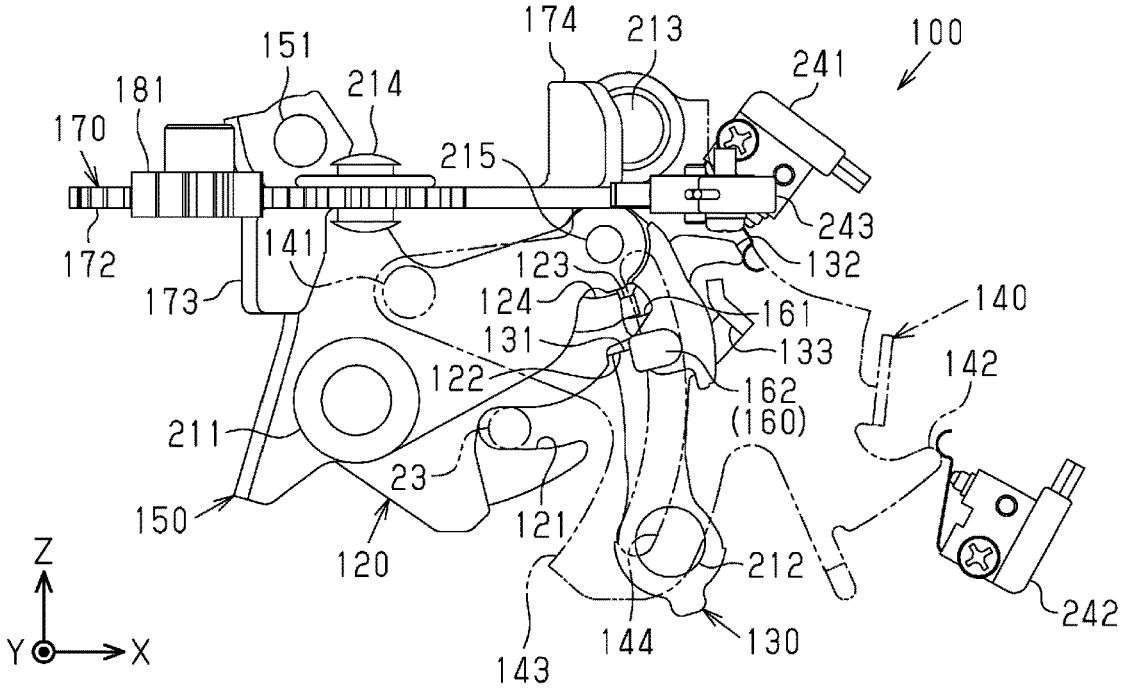
FIG. 22 is a plan view of the lock device when a closing action is completed.
Figure 23:
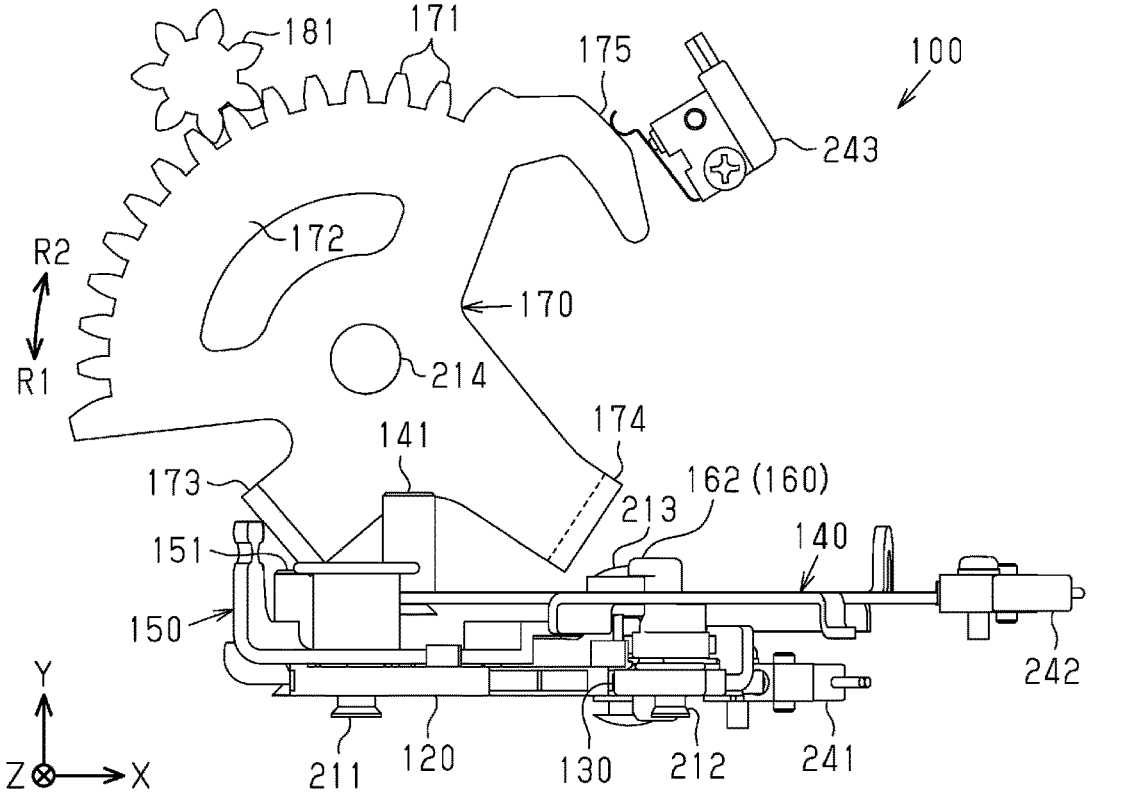
FIG. 23 is a front view of the lock device when the closing action is completed.

FIGS. 22 and 23 show a state of the lock device 100 at sixth timing t16, at which the drive lever 170 has returned to the neutral position.

As shown in FIGS. 22 and 23, when the drive lever 170 returns to the neutral position, the drive lever 170 pushes the drive lever switch 243. Thus, at sixth timing t16, the drive lever position recognition signal is deactivated, and the motor 182 of the lock driver 180 is stopped. This completes the closing action.

The operation of the lock device 100 during the open action will now be described.

Figure 24:
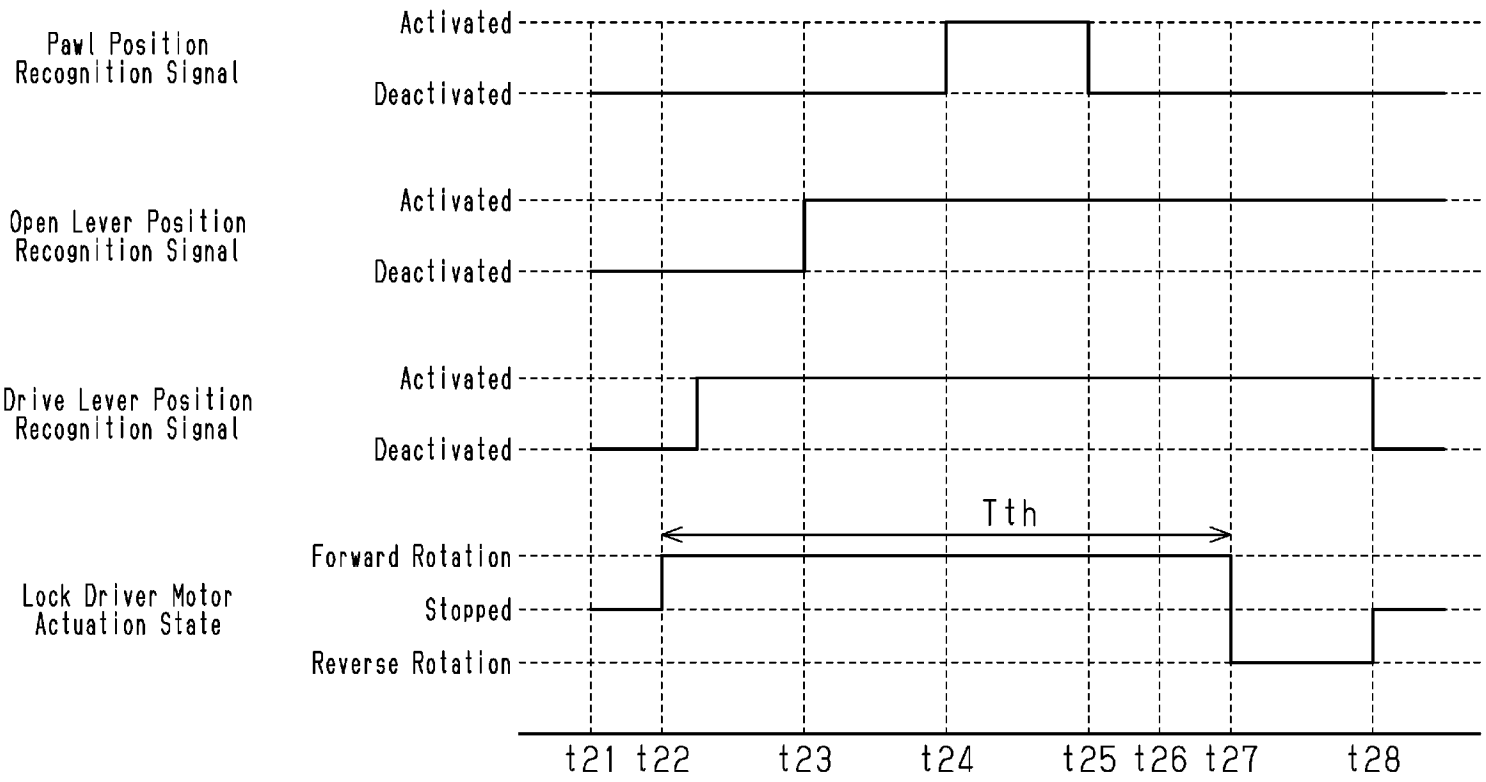
FIG. 24 is a timing chart showing changes in each signal and motor driving mode during an open action of the opening-closing body.

FIG. 24 is a timing chart showing the activation-deactivation states of the recognition signals and the actuation state of the motor 182 of the lock driver 180 during the open action. FIGS. 22, 23, 25 to 32, 14, and 15 show states of the lock device 100 corresponding to one of the timings shown in FIG. 24. In addition to FIGS. 14, 15, 22, and 23, in FIGS. 25 to 32, some of the components of the lock device 100 are simplified to facilitate the understanding.

At first timing t21, the cover 50 is located at the fully closed position. As shown in FIGS. 22 and 23, the latch 120 is located at the full latch position, and the pawl 130 is located at the hook position. The close lever 150 is engaged with the latch 120 and is maintained in a state where it has been rotated in the close direction CL. The open lever 140 is rotated to the limit in the urging direction of the open lever spring 223. The drive lever 170 is located at the neutral position. Thus, at first timing t21, the pawl position recognition signal, the open lever position recognition signal, and the drive lever position recognition signal are deactivated, and the motor 182 of the lock driver 180 is stopped, in the same manner as sixth timing t16, at which the closing action has been completed.

Subsequently, when starting the open action, the motor 182 of the lock driver 180 is rotated forward at second timing t22. This rotates the drive lever 170 in the first direction R1 from the neutral position. At a point in time after second timing t22, the drive lever 170 is separated from the drive lever switch 243, and the drive lever position recognition signal is activated. In the present embodiment, a timer is used to control the period for which the motor 182 of the lock driver 180 is rotated forward during the open action. More specifically, during the open action, after the motor 182 of the lock driver 180 is rotated forward for a predetermined time, the motor 182 of the lock driver 180 is rotated reversely. In the description hereafter, the time for which the motor 182 of the lock driver 180 is rotated forward during the open action may also be referred to as "the specified actuation time Tth."

Figure 25:
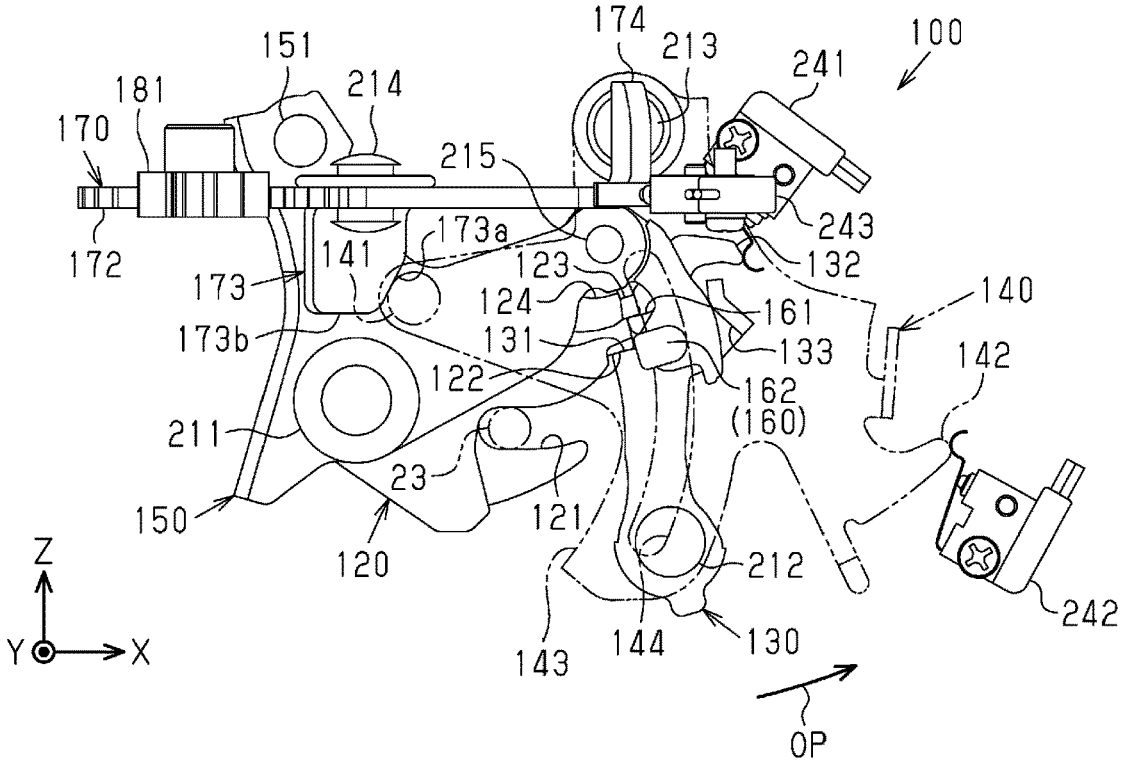
FIG. 25 is a plan view of the lock device when the drive lever is in contact with the open lever.
Figure 26:
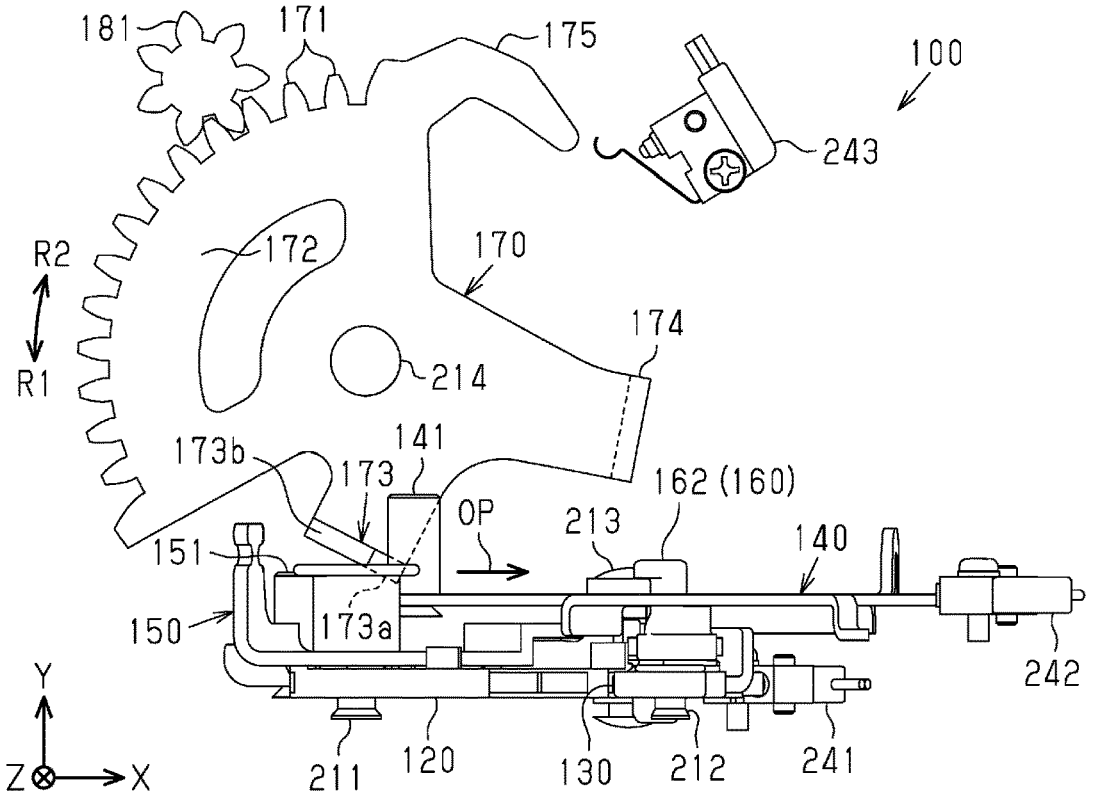
FIG. 26 is a front view of the lock device when the drive lever is in contact with the open lever.

FIGS. 25 and 26 show a state of the lock device 100 at third timing t23, at which the drive lever 170 is rotating in the first direction R1.

As shown in FIGS. 25 and 26, when the drive lever 170 rotates in the first direction R1 from the neutral position, the open lever pushing portion 173 of the drive lever 170 comes into contact with the open lever pin 141 of the open lever 140. More specifically, the first pushing part 173*a* of the open lever pushing portion 173 comes into contact with a proximal portion of the open lever pin 141. After the open lever pushing portion 173 comes into contact with the open lever pin 141, the open lever 140 rotates in the open direction OP in accordance with the rotation of the drive lever 170 in the first direction R1. At this time, the open lever pushing portion 173 slides on the open lever pin 141.

In the state shown in FIGS. 25 and 26, the open lever 140 is slightly rotated in the open direction OP from the state shown in FIGS. 22 and 23. Thus, the open lever 140 pushes the open lever switch 242, and the open lever position recognition signal is activated at third timing t23. Also, the open lever 140 pushes the interlock lever 160 through the slide groove 144 to move the interlock lever 160 in a direction away from the latch 120. As a result, the interlock lever 160 comes into contact with the engaging piece 133 of the pawl 130. When the interlock lever 160 comes into contact with the engaging piece 133 of the pawl 130, the engagement state is maintained between the first hook 131 of the pawl 130 and the first hook 122 of the latch 120.

Figure 27:
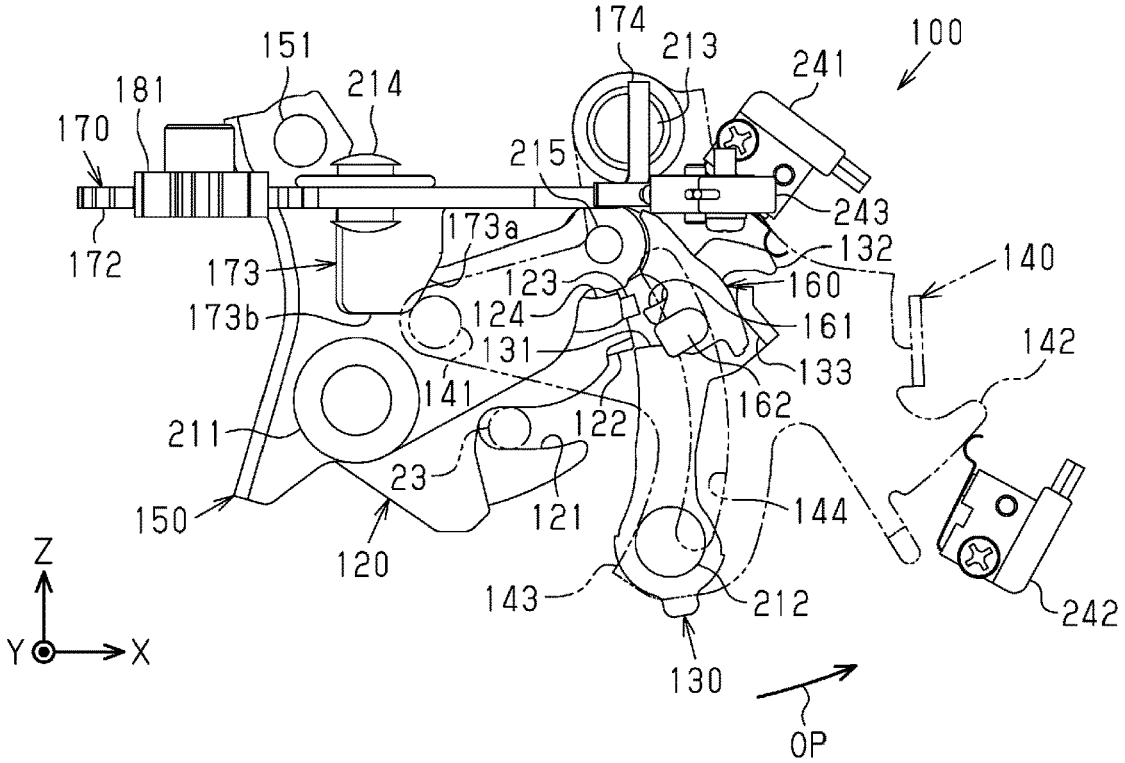
FIG. 27 is a plan view of the lock device when the pawl is rotated to a retracted position.
Figure 28:
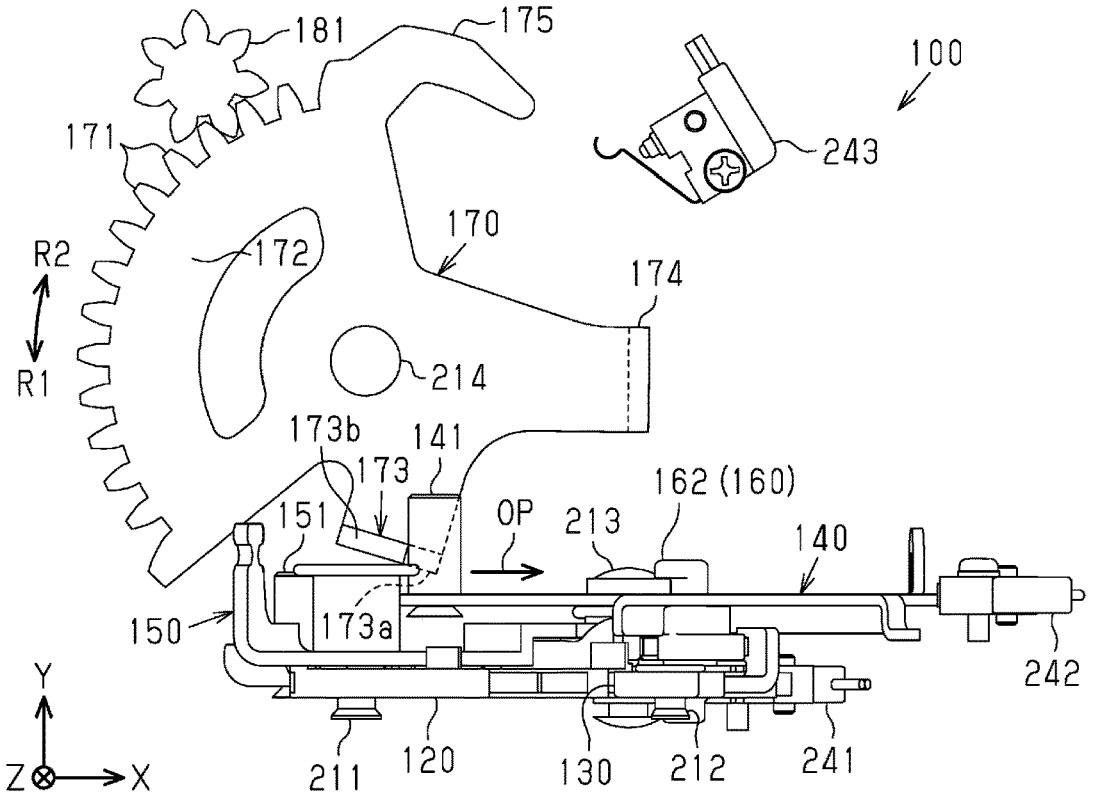
FIG. 28 is a front view of the lock device when the pawl is rotated to the retracted position.

FIGS. 27 and 28 show a state of the lock device 100 at fourth timing t24, at which the drive lever 170 is rotated in the first direction R1 from third timing t23.

As shown in FIGS. 27 and 28, when the drive lever 170 rotates further in the first direction R1, the open lever 140 is pushed by the open lever pushing portion 173 and rotated in the open direction OP. This moves the interlock lever 160, which engages the open lever 140, in a direction away from the latch 120. Since the interlock lever 160 is engaged with the engaging piece 133 of the pawl 130, when the interlock lever 160 moves in a direction away from the latch 120, the pawl 130 rotates in a direction away from the latch 120. As a result, the first hook 131 of the pawl 130 is unhooked from the first hook 122 of the latch 120. In other words, the pawl 130 rotates away from the latch 120, which is located at the full latch position, to the retracted position to allow rotation of the latch 120. As a result, the latch 120 starts to rotate in the urging direction of the latch spring 221. That is, the latch 120 starts to rotate from the full latch position toward the unlatch position. In the description hereafter, in the lock device 100, rotating the latch 120 from the full latch position to the unlatch position may also be referred to as "the unlatch action." When the pawl 130 is located at the retracted position, the pawl 130 pushes the pawl switch 241. Thus, at fourth timing t24, the pawl position recognition signal is activated.

Figure 29:
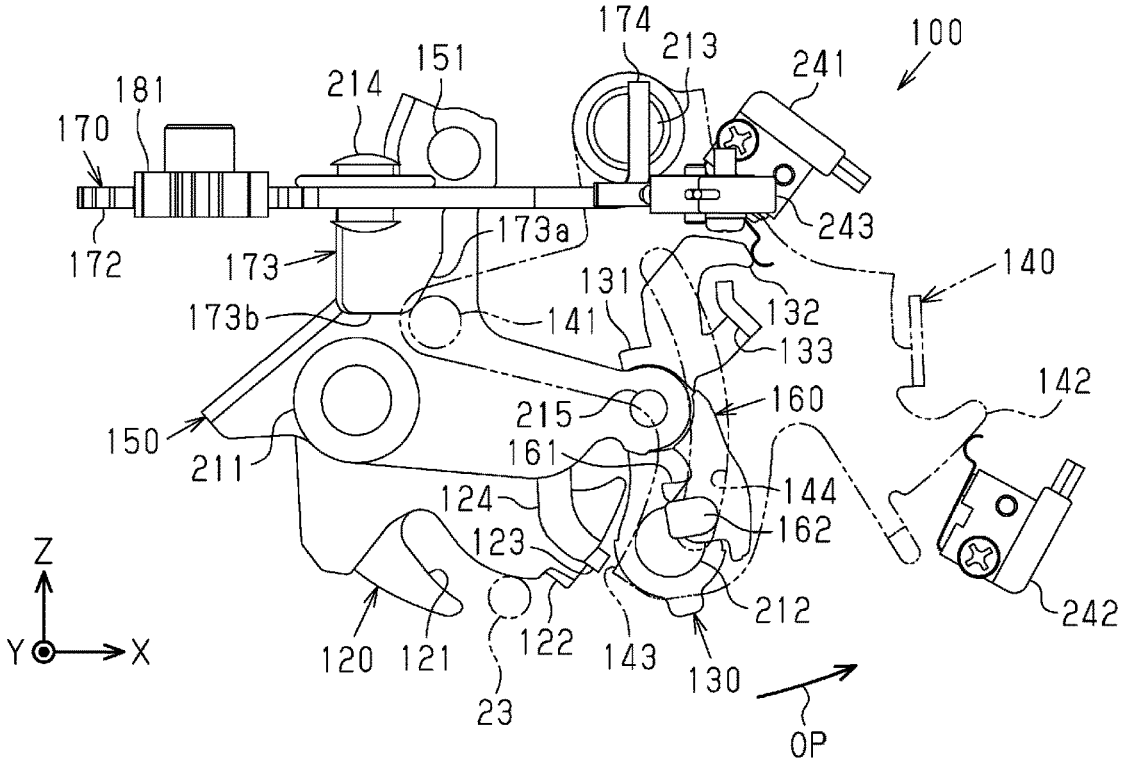
FIG. 29 is a plan view of the lock device when the unlatch action is completed.
Figure 30:
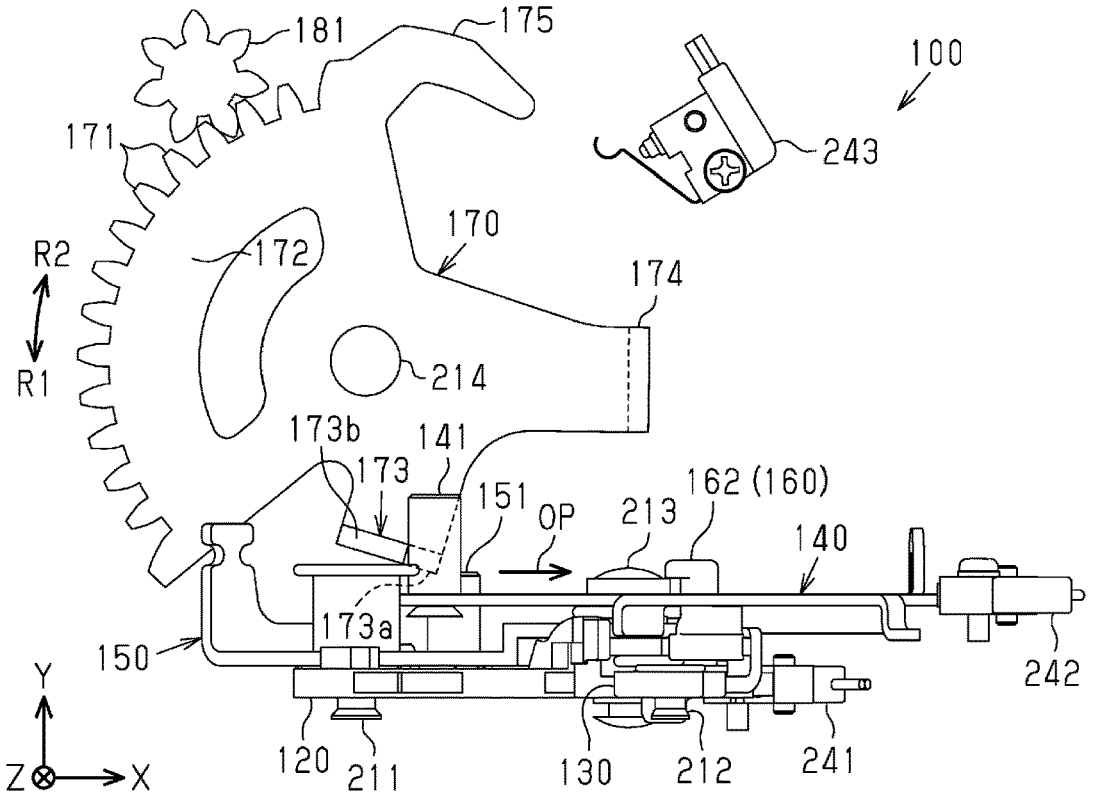
FIG. 30 is a front view of the lock device when the unlatch action is completed.

FIGS. 29 and 30 show a state of the lock device 100 at fifth timing t25, which is immediately after fourth timing t24.

As shown in FIGS. 29 and 30, when both the pawl 130 and the interlock lever 160 are unhooked from the latch 120, the latch 120 performs the unlatch action. Thus, the latch 120 rotates from the full latch position to the unlatch position. When the latch 120 performs the unlatch action, the striker 23 is discharged from the engaging groove 121 of the latch 120. That is, the latch 120 is unhooked from the striker 23, and the cover 50 is released from the restraint at the fully closed position.

When the latch 120 is rotated to the unlatch position, the pawl 130 rotates from the retracted position in a direction approaching the latch 120. As a result, the pawl 130 separates from the pawl switch 241, and the pawl position recognition signal is deactivated at fifth timing t25. When the latch 120 is rotated to the unlatch position, the close lever 150 is disengaged from the protrusion wall 124 of the latch 120 to allow the close lever 150 to rotate in the urging direction of the close lever spring 224. The close lever 150 rotates together with the interlock lever 160 in the urging direction of the close lever spring 224.

At a point in time of completing the unlatch action, the first pushing part 173*a* of the open lever pushing portion 173 pushes the open lever pin 141. In other words, at the point in time of completing the unlatch action of the latch 120, the first pushing part 173*a* is in contact with the open lever pin 141, and the second pushing part 173*b* is not in contact with the open lever pin 141. The open lever pushing portion 173 rotates in the first direction R1 while rotating the open lever 140 in the open direction OP at least until the unlatch action of the latch 120 is completed.

Figure 31:
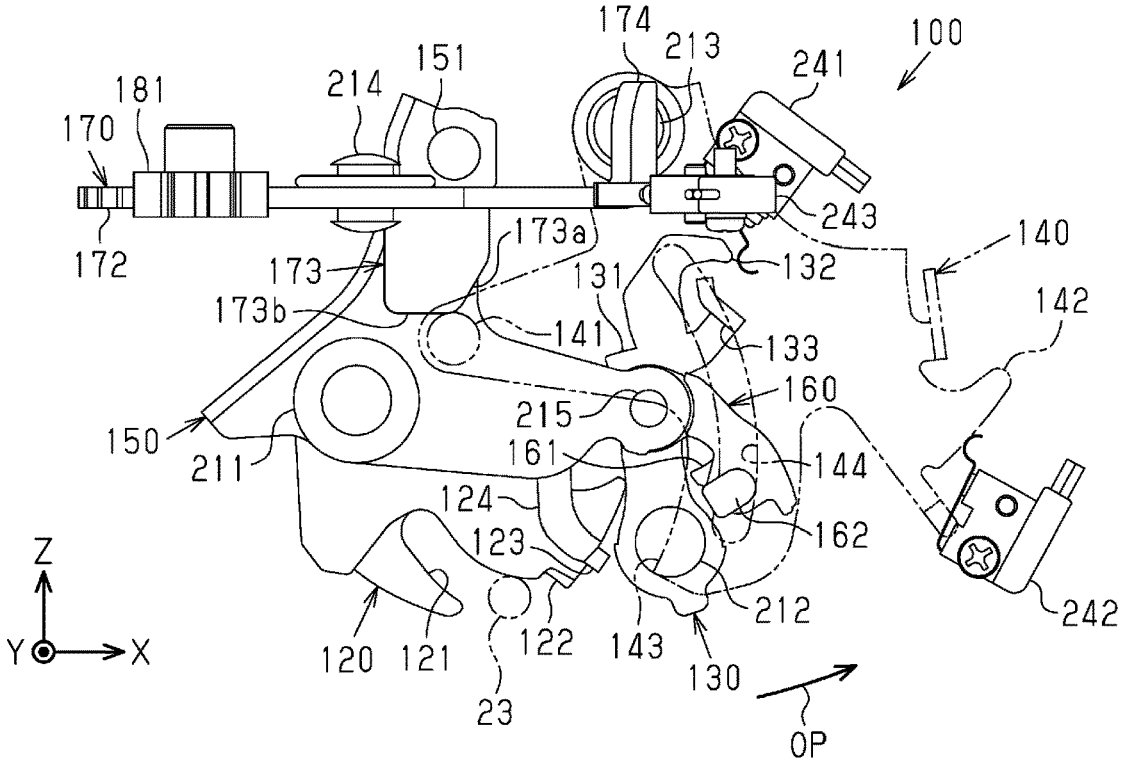
FIG. 31 is a plan view of the lock device when the rotation of the drive lever is restricted.
Figure 32:
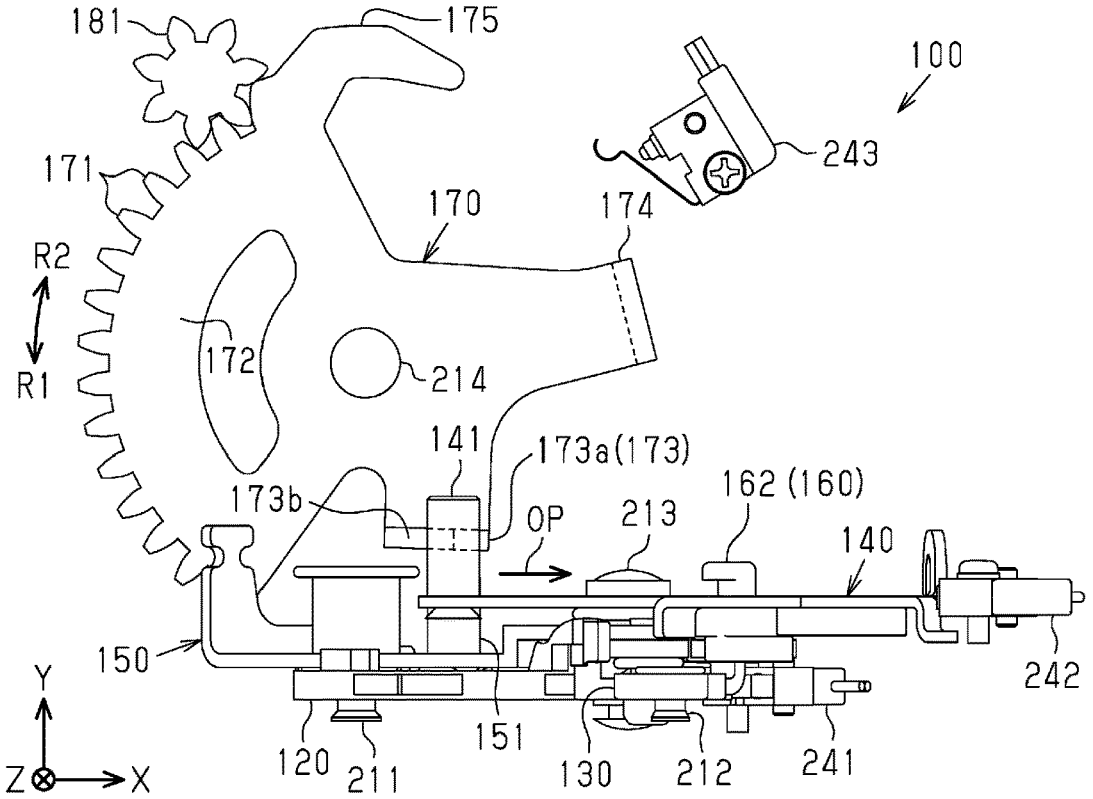
FIG. 32 is a front view of the lock device when the rotation of the drive lever is restricted.

FIGS. 31 and 32 show a state of the lock device 100 at sixth timing t26, at which the drive lever 170 is rotated to the limit in the first direction R1.

As shown in FIGS. 31 and 32, when the motor 182 of the lock driver 180 continues to rotate forward and the drive gear 181 meshes with the outermost one of the external teeth 171 on the sector gear 172 of the drive lever 170 in the second direction R2, the rotation of the drive gear 181 is locked. Accordingly, the rotation of the drive lever 170 in the first direction R1 is restricted.

When the rotation of the drive lever 170 in the first direction R1 is restricted, the second pushing part 173*b* of the open lever pushing portion 173 pushes the open lever pin 141. More specifically, during the open action, after the unlatch action of the latch 120 is completed and before the rotation of the drive lever 170 in the first direction R1 is restricted, the state in which the first pushing part 173*a* of the drive lever 170 pushes the open lever pin 141 changes to the state in which the second pushing part 173*b* of the drive lever 170 pushes the open lever pin 141.

Since the second pushing part 173*b* includes a flat surface that is orthogonal to the rotation axis of the drive lever 170, when the second pushing part 173*b* pushes the open lever pin 141, the open lever 140 does not rotate in the open direction OP even when the drive lever 170 rotates in the first direction R1. More specifically, the second pushing part 173*b*, which differs from the first pushing part 173*a*, does not transmit force that rotates the open lever 140 in the open direction OP to the open lever 140. That is, the second pushing part 173*b* only restricts the rotation of the open lever 140 in the urging direction of the open lever spring 223. In this point, after the unlatch action of the latch 120 is completed, the drive lever 170 rotates in the first direction R1 without rotating the open lever 140 in the open direction OP until the rotation of the drive lever 170 is locked.

As shown in FIG. 32, when the rotation of the drive lever 170 in the first direction R1 is restricted, the second pushing part 173*b* of the open lever pushing portion 173 is in contact with a distal portion of the open lever pin 141. As shown in FIGS. 26, 28, 30, and 32, in the open action, the movement path of the open lever pushing portion 173 of the drive lever 170 is arc-shaped. Therefore, in the open lever pin 141, the point of contact with the open lever pushing portion 173 changes from the proximal position toward the distal position as the open action advances.

During the unlatch action, when moving the pawl 130 from the hook position to the retracted position, the first hook 122 of the latch 120 and the first hook 131 of the pawl 130 need to slide on each other. Due to the magnitude relationship between a static friction coefficient and a dynamic friction coefficient, the largest force is transmitted from the drive lever 170 to the open lever 140 when the first hook 122 and the first hook 131 start to slide on each other. In other words, during the open action, when the drive lever 170 rotates in the first direction R1 from the state shown in FIG. 26, the largest load is applied to the open lever pin 141. That is, the force of the open lever pushing portion 173 that pushes the open lever pin 141 is maximal at the point in time of starting the unlatch action.

When the rotation of the drive lever 170 in the first direction R1 is restricted, a load is applied to the drive lever 170 and the drive gear 181. Positions of the drive lever 170 and the drive gear 181 that receive the load are the portions forming gears, that is, portions having a high rigidity to the load. Therefore, the application of the load does not adversely affect the drive lever 170 and the drive gear 181.

At seventh timing t27, the time elapsed from when the motor 182 of the lock driver 180 rotates forward equals the specified actuation time, and the rotation direction of the motor 182 of the lock driver 180 is inversed. That is, the motor 182 is rotated reversely, and the rotation direction of the drive lever 170 is switched from the first direction R1 to the second direction R2. In this regard, it is preferred that the specified actuation time Tth is longer than the time that takes the drive lever 170 to rotate from the neutral position shown in FIG. 23 to the terminal position shown in FIG. 32. It is preferred that the specified actuation time Tth is set taking into consideration variations in the neutral position and environmental factors such as outside temperature.

At eighth timing t28, when the drive lever position recognition signal is deactivated, the motor 182 of the lock driver 180 is stopped. That is, as shown in FIGS. 14 and 15, the drive lever 170 returns to the neutral position, and the motor 182 of the lock driver 180 is stopped. This completes the open action.

The advantages of the present embodiment will now be described.

(1) In the drive lever 170, the open lever pushing portion 173 and the close lever pushing portion 174 extend in opposite directions. With this configuration, the distance between the open lever pushing portion 173 and the close lever pushing portion 174 is freely set in the rotation direction of the drive lever 170. As a result, during the open action, when the drive lever 170 returns to the neutral position, the close lever pushing portion 174 is not likely to push the close lever 150. Also, during the closing action, when the drive lever 170 returns to the neutral position, the open lever pushing portion 173 is not likely to push the open lever 140. Thus, the lock device 100 increases the neutral range of the drive lever 170.

(2) In the drive lever 170, the length L1 from the rotational center of the drive lever 170 to the open lever pushing portion 173 differs from the length L2 from the rotational center of the drive lever 170 to the close lever pushing portion 174. This allows the lock device 100 to increase the degree of freedom for designing the layout of the open lever 140 and the close lever 150 as compared to a configuration in which the length L1 from the rotational center of the drive lever 170 to the open lever pushing portion 173 is equal to the length L2 from the rotational center of the drive lever 170 to the close lever pushing portion 174.

(3) The force used to perform the full latch action of the latch 120, that is, the force used to rotate the close lever 150 in the close direction CL, tends to be greater than force used to perform the unlatch action of the latch 120, that is, the force used to rotate the open lever 140 in the open direction OP. In this regard, in the lock device 100, the length L2 from the rotational center of the drive lever 170 to the close lever pushing portion 174 is greater than the length L1 from the rotational center of the drive lever 170 to the open lever pushing portion 173. This allows the lock device 100 to extend the length L2 from the rotational center of the drive lever 170 to the close lever pushing portion 174, that is, extend the moment arm. As a result, the force transmitted to the close lever 150 is increased.

(4) In the open action, the unlatch action of the latch 120 needs the largest force when starting to rotate the pawl 130 in the retracted position. That is, the force of the open lever pushing portion 173 that pushes the open lever pin 141 is increased at the initial stage of the unlatch action. In this regard, in the lock device 100, in the open lever pin 141, the point of contact with the open lever pushing portion 173 changes from the proximal position toward the distal position as the open action advances. That is, when the open lever pushing portion 173 pushes the open lever pin 141 with the largest force, the open lever pushing portion 173 pushes the proximal position of the open lever pin 141. The lock device 100 reduces bending stress applied to the proximal end of the open lever pin 141 during the open action.

(5) In the closing action, the full latch action of the latch 120 needs the largest force when completing rotation of the latch 120 to the full latch position. That is, the force of the close lever pushing portion 174 that pushes the close lever pin 151 is increased at the final stage of the full latch action. In this regard, in the lock device 100, in the close lever pin 151, the point of contact with the close lever pushing portion 174 changes from the distal position toward the proximal position as the closing action advances. That is, when the close lever pushing portion 174 pushes the close lever pin 151 with the large force, the close lever pushing portion 174 pushes the proximal position of the close lever pin 151. The lock device 100 reduces bending stress applied to the proximal end of the close lever pin 151 during the closing action.

(6) During the open action, after the latch 120 performs the unlatch action, the lock device 100 rotates the drive lever 170 in the first direction R1 such that the open lever 140 does not rotate in the open direction OP. Thus, after completion of the unlatch action, even when the drive lever 170 continues to rotate in the first direction R1, the lock device 100 limits an overload applied to the open lever 140.

(7) During the open action, the lock device 100 switches the portion of the drive lever 170 that pushes the open lever 140 from the first pushing part 173*a* to the second pushing part 173*b*. Thus, the lock device 100 allows the drive lever 170 to continue to rotate in the first direction R1 such that the open lever 140 does not rotate in the open direction OP. In addition, the second pushing part 173*b* restricts rotation of the open lever 140 in the direction opposite to the open direction OP. This allows the lock device 100 to restrict changes in the position of the open lever 140 after the latch 120 performs the full latch action.

(8) During the open action, the lock device 100 completes the unlatch action of the latch 120 before the drive gear 181 becomes nonrotatable by meshing with the outermost one of the external teeth 171 of the drive lever 170 in the second direction R2. That is, during the open action, when the drive gear 181 becomes nonrotatable, the unlatch action of the latch 120 has been completed. In the lock device 100, the configuration of the drive gear 181 becoming nonrotatable during the open action is used to simplify the control of the motor 182 that drives the drive gear 181. In the present embodiment, the lock device 100 sets the driving time of the motor 182 during the open action to the specified actuation time Tth. That is, during the open action, the lock device 100 drives the motor 182 for the specified actuation time Tth to perform the unlatch action of the latch 120.

(9) In the lock device 100, if the rotation axis of the open lever 140, the rotation axis of the close lever 150, and the rotation axis of the drive lever 170 extend in the same direction, the open lever 140, the close lever 150, and the drive lever 170 need to be arranged on the same plane. This decreases the degree of freedom for arranging components of the device. In this regard, in the lock device 100, the rotation axis of the drive lever 170 extends in a direction that differs from that of the rotation axis of the open lever 140 and that of the rotation axis of the close lever 150. This eliminates the need for arranging the open lever 140, the close lever 150, and the drive lever 170 on the same plane. Thus, the degree of freedom for arranging components in the lock device 100 is increased.

(10) In the direction in which the rotation axis of the drive lever 170 extends, the rotation axis of the open lever 140 and the rotation axis of the close lever 150 are located at opposite sides of the drive lever 170. Thus, in the lock device 100, the rotation axis of the open lever 140 and the rotation axis of the close lever 150 are separated from each other in the direction in which the rotation axis of the drive lever 170 extends.

(11) In the direction in which the rotation axis of the drive lever 170 extends, the close lever pin 151 and the open lever pin 141 are located at opposite sides of the drive lever 170. Thus, in the lock device 100, the open lever pin 141 and the close lever pin 151 are separated from each other in the direction in which the rotation axis of the drive lever 170 extends.

(12) In the lock device 100, the second plate 112 is inclined from the first plate 111, so that the rotation axis of the drive lever 170 extends in a direction that differs from that of the rotation axis of the open lever 140 and that of the rotation axis of the close lever 150.

(13) In the lock device 100, as viewed from a direction in which the x-axis extends, the rotation axis of the drive lever 170 is orthogonal to the rotation axis of the open lever 140 and the rotation axis of the close lever 150. Thus, in the lock device 100, the positional relationship of the drive lever 170 with the open lever 140 and the close lever 150 is readily controlled.

The present embodiment may be modified as follows. The present embodiment and the following modified examples can be combined as long as the combined modified examples remain technically consistent with each other.

The lock device 100 may be configured to hold the latch 120 on the action switching position by hooking the pawl 130 on the latch 120 instead of hooking the interlock lever 160 on the latch 120. In this case, it is preferred that the first hook 122 and the second hook 123 are separated from each other in the rotation direction of the latch 120, and that the pawl 130 hooks on the second hook 123, thereby holding that the latch 120 on the action switching position.

The shape and size of the drive lever 170 may be changed in any manner. For example, as the drive lever 170 is viewed in the direction in which the rotation axis of the drive lever 170 extends, the length L1 from the rotational center of the drive lever 170 to the open lever pushing portion 173 may be greater than or equal to the length L2 from the rotational center of the drive lever 170 to the close lever pushing portion 174.

The shape and size of the open lever 140 and the close lever 150 may be changed in any manner. For example, in the direction in which the rotation axis of the drive lever 170 extends, the rotation axis of the open lever 140 and the rotation axis of the close lever 150 may be located at one side of the drive lever 170 or may be located at the other side of the drive lever 170. In the direction in which the rotation axis of the drive lever 170 extends, the open lever pin 141 and the close lever pin 151 may be located at one side of the drive lever 170 or may be located at the other side of the drive lever 170.

During the open action, in the open lever pin 141, the point of contact with the open lever pushing portion 173 does not have to change from the proximal position toward the distal position as the open action advances. For example, the point of contact does not have to change from the proximal position or does not have to change from the distal position as the open action advances. The point of contact may change from the distal position toward the proximal position as the open action advances.

During the closing action, in the close lever pin 151, the point of contact with the close lever pushing portion 174 does not have to change from the distal position toward the proximal position as the closing action advances. For example, the point of contact does not have to change from the proximal position or does not have to change from the distal position as the closing action advances. The point of contact may change from the proximal position toward the distal position as the closing action advances.

The direction in which the open lever pin 141 of the open lever 140 extends may be inclined from the rotation axis of the open lever 140. Also, the direction in which the close lever pin 151 of the close lever 150 extends may be inclined from the rotation axis of the close lever 150.

The lock device 100 may include one or more relay levers that relay transmission of power from the drive lever 170 to the close lever 150 during the closing action. The lock device 100 may include one or more relay levers that relay transmission of power from the close lever 150 and the interlock lever 160 to the latch 120 during the closing action. That is, the drive lever 170 does not necessarily have to directly drive the close lever 150, and the close lever 150 and the interlock lever 160 do not necessarily have to directly drive the latch 120.

The lock device 100 may include one or more relay levers that relay transmission of power from the drive lever 170 to the open lever 140, one or more relay levers that relay transmission of power from the open lever 140 to the interlock lever 160, and one or more relay levers that relay transmission of power from the interlock lever 160 to the pawl 130 during the open action. That is, the drive lever 170 does not necessarily have to directly drive the open lever 140. The open lever 140 does not necessarily have to directly drive the interlock lever 160. The interlock lever 160 does not necessarily have to directly drive the pawl 130.

In the housing 110, the first plate 111 may be separate from the second plate 112.

The lock device 100 may be configured to allow a user to operate a door handle and perform the open action, for example, when the lock driver 180 is broken. More specifically, the lock device 100 may include a cable that rotates the open lever 140 in the open direction OP in accordance with the operation of the door handle.

The lock device 100 may be arranged in the opening 22, and the striker 23 may be arranged on the cover 50.

The lock device 100 may be used as a door lock device that restrains a front door, a side door, and a rear door at a fully closed position. The front door and the side door may be a swing door or a sliding door.

During the open action, the state in which the first pushing part 173*a* of the open lever pushing portion 173 pushes the open lever pin 141 may be switched to the state in which the second pushing part 173*b* of the open lever pushing portion 173 pushes the open lever pin 141 at the point in time of starting the unlatch action or any subsequent time. That is, as shown in FIG. 27, the switching may be executed at a point in time of unhooking the first hook 131 of the pawl 130 from the first hook 122 of the latch 120 or any subsequent time. In other words, the open lever pushing portion 173 may be configured during the open action to rotate in the first direction R1 while rotating the open lever 140 in the open direction OP at least until the latch 120 starts the unlatch action, and to rotate in the first direction R1 without rotating the open lever 140 in the open direction OP after the latch 120 starts the unlatch action.

During the open action, the controller 300 may reversely rotate the motor 182 of the lock driver 180 before the outermost one of the external teeth 171 in the second direction R2 meshes with the drive gear 181 as a result of rotation of the drive lever 170 in the first direction R1. In this configuration, the motor 182 is reversely rotated after the unlatch action is completed. In this case, the controller 300 may determine a point in time of reversely rotating the motor 182 of the lock driver 180, for example, based on the time the motor 182 is rotated forward or based on the activation-deactivation state of a switch that detects the position of the latch 120 or the like.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A lock device provided on one of a vehicle body including an opening or an opening-closing body that opens and closes the opening of the vehicle body, the lock device being configured to hook on a striker, which is provided on the other one of the vehicle body or the opening-closing body, to restrain the opening-closing body at a fully closed position when the opening is closed, the lock device comprising:

a latch configured to rotate between a full latch position where the latch hooks on the striker and an unlatch position where the latch is unhooked from the striker, the latch being urged from the full latch position toward the unlatch position;

a pawl configured to rotate between a hook position where the pawl hooks on the latch located at the full latch position to restrict rotation of the latch toward the unlatch position and a retracted position where the pawl is separated from the latch located at the full latch position to allow rotation of the latch, the pawl being urged from the retracted position toward the hook position;

an open lever configured to rotate in an open direction to rotate the pawl to the retracted position, the opening lever being urged in a direction opposite to the open direction; and a close lever configured to rotate in a close direction to rotate the latch to the full latch position a drive lever including an open lever pushing portion, wherein, when rotated in a first direction, the open lever pushing portion pushes the open lever to rotate the open lever in the open direction, wherein rotating the latch from the full latch position to the unlatch position is referred to as an unlatch action, rotating the drive lever in the first direction so that the latch performs the unlatch action is referred to as an open action, during the open action, the open lever pushing portion rotates in the first direction while rotating the open lever in the open direction at least until the latch starts the unlatch action, and rotates in the first direction without rotating the open lever in the open direction after the latch starts the unlatch action;

and the close lever is urged in a direction opposite to the close direction, the drive lever includes a close lever pushing portion, when rotated in a second direction that is opposite to the first direction, the close lever pushing portion pushes the close lever to rotate the close lever in the close direction, a rotation axis of the drive lever and a rotation axis of the open lever extend in different directions, and the rotation axis of the drive lever and a rotation axis of the close lever extend in different directions.

2. The lock device according to claim 1, wherein the open lever pushing portion includes a first pushing part and a second pushing part, the first pushing part is configured to rotate the open lever in the open direction at least until the latch starts the unlatch action, and the second pushing part is configured to restrict rotation of the open lever in the direction opposite to the open direction after the latch starts the unlatch action.

3. The lock device according to claim 2, further comprising:

a drive gear configured to drive the drive lever, wherein the drive lever includes external teeth arranged in a rotation direction of the drive lever, the external teeth are configured to mesh with the drive gear, in the drive lever, a direction opposite to the first direction is referred to as a second direction, and during the open action, before an outermost one of the external teeth in the second direction meshes with the drive gear as the drive lever rotates in the first direction, a state changes from a state in which the first pushing portion pushes the open lever to a state in which the second pushing portion pushes the open lever.

4. The lock device according to claim 1, wherein, as the drive lever is viewed in the direction in which the rotation axis of the drive lever extends, a length from a rotation center of the drive lever to the open lever pushing portion differs from a length from the rotation center of the drive lever to the close lever pushing portion.

5. The lock device according to claim 4, wherein, as the drive lever is viewed in the direction in which the rotation axis of the drive lever extends, the length from the rotation center of the drive lever to the close lever pushing portion is greater than the length from the rotation center of the drive lever to the open lever pushing portion.

6. The lock device according to claim 1, wherein, in a direction in which the rotation axis of the drive lever extends, the rotation axis of the open lever and the rotation axis of the close lever are located at opposite sides of the drive lever.

7. The lock device according to claim 1, wherein the open lever includes an open lever engaging portion that is configured to be a point of contact with the open lever pushing portion, the close lever includes a close lever engaging portion that is configured to be a point of contact with the close lever pushing portion, and in a direction in which the rotation axis of the drive lever extends, the close lever engaging portion and the open lever engaging portion are located at opposite sides of the drive lever.

8. The lock device according to claim 7, wherein the open lever engaging portion extends toward a rotation path of the open lever pushing portion when the drive lever rotates in the first direction, in the open lever engaging portion, the point of contact with the open lever pushing portion changes from a proximal position of the open lever engaging portion toward a distal position of the open lever engaging portion as the open lever rotates in the open direction.

9. The lock device according to claim 7, wherein the close lever engaging portion extends toward a rotation path of the close lever pushing portion when the drive lever rotates in the second direction, and in the close lever engaging portion, the point of contact with the close lever pushing portion changes from a distal position of the close lever engaging portion toward a proximal position of the close lever engaging portion as the close lever rotates in the close direction.

10. The lock device according to claim 1, further comprising:

a first plate that rotationally supports the latch, the pawl, the open lever, and the close lever; and a second plate that extends from the first plate in a direction intersecting the first plate and supports the drive lever.

11. The lock device according to claim 1, wherein the rotation axis of the open lever and the rotation axis of the close lever extend in a same direction, and as viewed in a direction that is orthogonal to the rotation axis of the drive lever and the rotation axis of the open lever, the rotation axis of the drive lever is orthogonal to the rotation axis of the open lever and the rotation axis of the close lever.

* * * * *